US011220382B2

(12) United States Patent
Bressan et al.

(10) Patent No.: US 11,220,382 B2
(45) Date of Patent: Jan. 11, 2022

(54) TAMPER-EVIDENT AND CHILD-PROOF COUPLING SYSTEM, CONTAINER COMPRISING SUCH A COUPLING SYSTEM, PROCESS OF MAKING SAID COUPLING SYSTEM AND SAID CONTAINER

(71) Applicant: I.G.B. S.r.l., Milan (IT)

(72) Inventors: Dino Bressan, Milan (IT); Michel Bressan, Induno Olona (IT); Alessio Bressan, Varese (IT); Alberto Gandolla, Induno Olona (IT)

(73) Assignee: I.G.B. S.r.l, Milan (IT)

( * ) Notice: Subject to any disclaimer, the term of this patent is extended or adjusted under 35 U.S.C. 154(b) by 0 days.

(21) Appl. No.: 16/519,565

(22) Filed: Jul. 23, 2019

(65) Prior Publication Data

US 2020/0031514 A1 Jan. 30, 2020

(51) Int. Cl.
*B65D 55/02* (2006.01)
*B65D 5/66* (2006.01)

(52) U.S. Cl.
CPC ..... *B65D 55/024* (2013.01); *B65D 5/6608* (2013.01); *B65D 55/026* (2013.01); (Continued)

(58) Field of Classification Search
CPC ..... B65D 5/6608; B65D 2215/00–004; B65D 2401/10; B65D 2401/15; B65D 2401/55; (Continued)

(56) References Cited

U.S. PATENT DOCUMENTS 1,277,459 A * 9/1918 Myers ..... B65D 5/6661 229/148
2,711,282 A 6/1955 D'Esposito
(Continued)

FOREIGN PATENT DOCUMENTS

BE 410524 A 8/1935
CA 2989273 A1 * 12/2016 ..... B65D 5/6608
(Continued)

OTHER PUBLICATIONS

Search Report and Written Opinion for Italian Application No. 102018000007472, dated Apr. 12, 2019, 7 pages.

*Primary Examiner* — Nathan J Newhouse
*Assistant Examiner* — Phillip D Schmidt
(74) *Attorney, Agent, or Firm* — Fish & Richardson P.C.

(57) ABSTRACT

The present disclosure relates to a tamper-evident and child-proof coupling system. The coupling system includes a first base portion, a second base portion, a slit, and a closing septum. The first base portion includes a first coupling portion. The second base portion includes a second coupling portion. The first and second coupling portions are configured to define a priming configuration of the coupling system when the first and second coupling portion are engaged to each other. The slit is defined on the first base portion or the second base portion and is configured to receive an opening device. The opening device is configured to disengage the first and second coupling portions. The closing septum is adjustable to a first or second configuration. In the first configuration, the closing septum occludes the slit. In the second configuration, the closing septum is configured to expose the slit.

16 Claims, 14 Drawing Sheets

(52) U.S. Cl.
CPC ..... *B65D 2215/04* (2013.01); *B65D 2401/10* (2020.05); *B65D 2401/55* (2020.05)

(58) Field of Classification Search
CPC ... B65D 2401/05; B65D 55/024; B65D 55/06
USPC ..... 229/102; 206/807; 220/275, 284
See application file for complete search history.

(56) References Cited

U.S. PATENT DOCUMENTS 3,357,630 A * 12/1967 Michelitsch ..... B65D 5/6661 229/148
4,417,661 A * 11/1983 Roccaforte ..... B65D 5/72 229/149
4,535,929 A * 8/1985 Sherman, II ..... B65D 5/103 229/142
4,770,338 A 9/1988 Tatusch
5,137,208 A * 8/1992 Wang ..... B65D 77/04 229/102
5,265,794 A 11/1993 Johnston
8,257,980 B2 * 9/2012 Schalkhammer ..... G01N 21/78 436/164
2005/0173291 A1 8/2005 Covey et al.
2007/0017963 A1 * 1/2007 Robinson ..... B65D 5/0254 229/148
2016/0180747 A1 * 6/2016 Pietarinen ..... C09J 7/243 206/438

FOREIGN PATENT DOCUMENTS

GB 2397294 7/2004
JP H11-245940 9/1999
JP 2014-141276 8/2014
WO WO2015170203 A1 11/2015
WO WO2016198978 12/2016
WO WO-2016198978 A1 * 12/2016 ..... B65D 5/0254

* cited by examiner

FIG.1
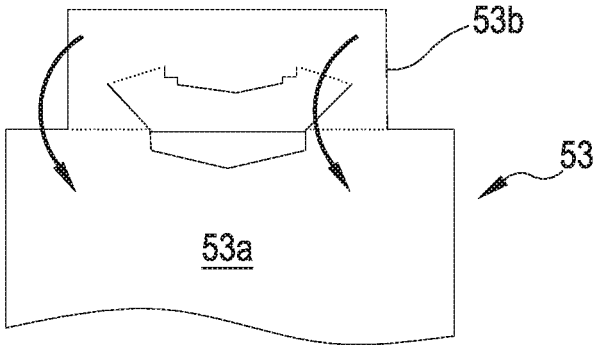
FIG.2
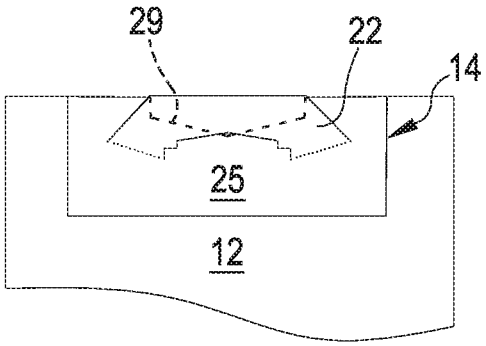
FIG.3
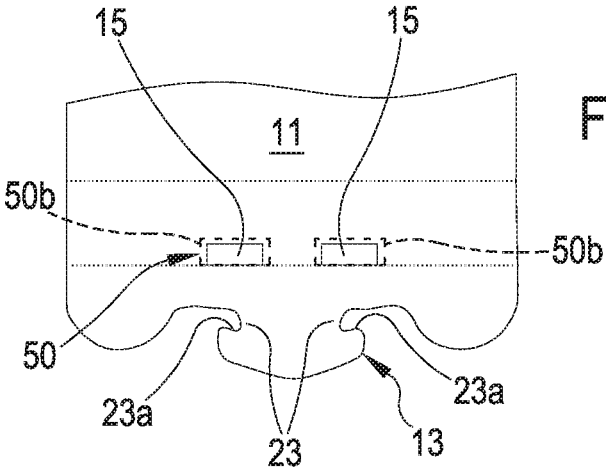
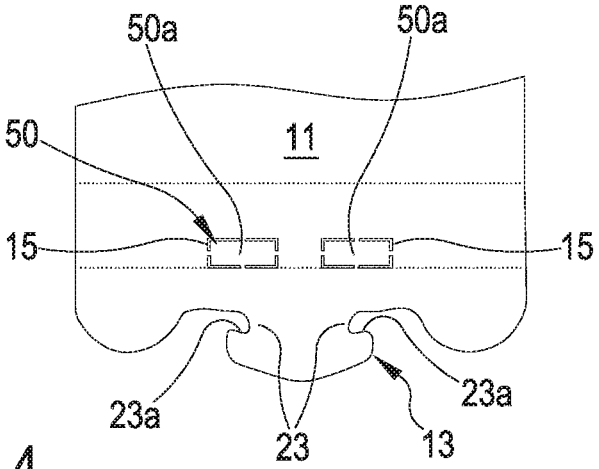
FIG.4

FIG.12
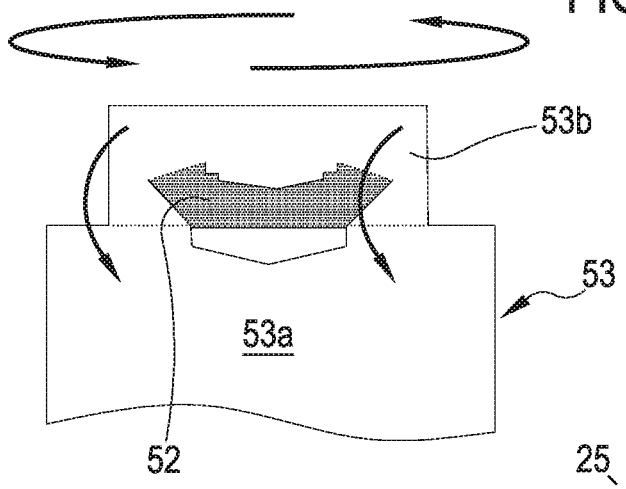
FIG.13
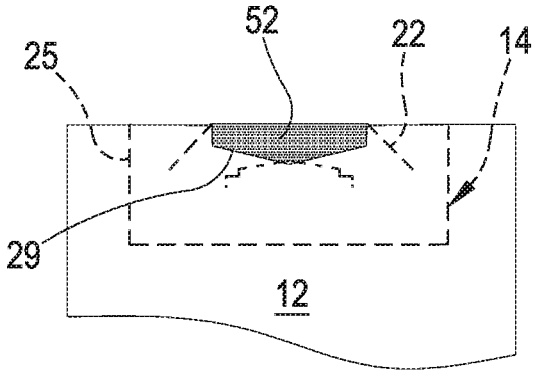
FIG.14
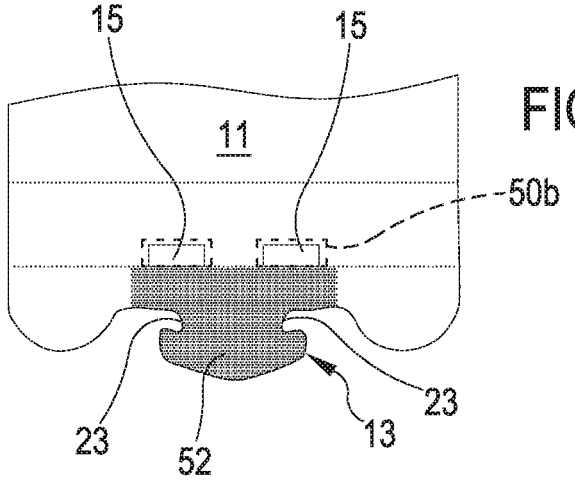
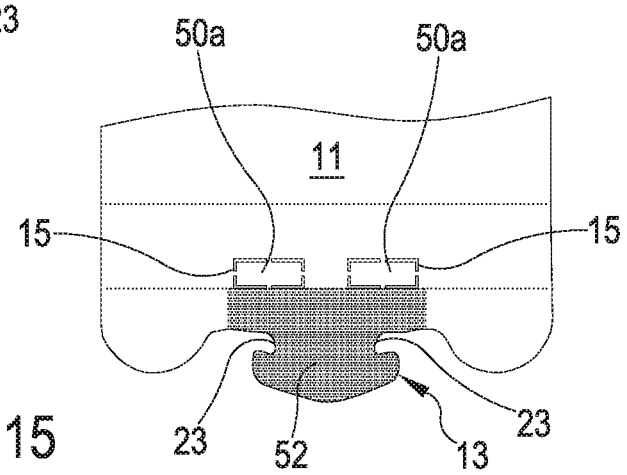
FIG.15

TAMPER-EVIDENT AND CHILD-PROOF COUPLING SYSTEM, CONTAINER COMPRISING SUCH A COUPLING SYSTEM, PROCESS OF MAKING SAID COUPLING SYSTEM AND SAID CONTAINER

CROSS REFERENCE TO RELATED APPLICATIONS

This patent application claims priority under 35 U.S.C § 119 to Italian Patent Application No. 102018000007472, filed Jul. 24, 2018, the entire contents of which are incorporated herein by reference.

TECHNICAL FIELD

This disclosure relates to child-proof and tamper-evident coupling systems and containers including such coupling systems. The disclosure also relates to a process of making the child-proof and tamper-evident coupling systems and containers. Such coupling systems may find application in the fields requiring packaging of products and in fields that require preventing children from opening such packages for safety reasons (e.g., child-resistant packaging). Such coupling systems can also be used in fields that require evidence of package tampering. For example, the coupling systems can be useful in the packaging sectors for pharmaceutical, cosmetic, and food products.

BACKGROUND

Child-proof containers available on the market are designed to be difficult to be opened by a majority of children under the age of 5. This type of containers are, for example, used in the pharmaceutical sector to prevent children of reduced age from ingesting potentially harmful drugs and accidental poisoning.

A first type of child-proof container includes a box-shaped case adapted to receive a blister therein intended to contain a plurality of products. The case has, at opposite longitudinal side walls, two slits. The blister has a substantially rectangular shape and includes two protrusions suitable for inserting into the respective slits of the case: when the blister is housed in the case, the engagement of the protrusions with the slits prevents the extraction of the same blister by pulling the blister away from the case. If one wants to remove the blister from the case, the protrusions must be pressed in such a way as to push the blister towards the inside of the case itself and make it disengage from the slits.

A second type of child-proof container includes a cardboard case having a box-like shape adapted to accommodate a plastic blister. Also, for this second type of container, the case is configured to cooperate with the blister to allow the latter to be locked inside the container. The case is provided with a button-shaped portion which acts on the blister to allow disengagement from the casing and therefore, the extraction of the container.

Although the containers described above have an opening system adapted to prevent access to the blister by children under 5, they have limitations and drawbacks. In fact, these containers define a secure closure by means of the cooperation between the case and the blister, a condition which causes these containers to have limited flexibility in their use. For example, the case can only receive a blister specifically designed and made for that particular case. Furthermore, the blisters must be made using specific production methods. For example, the blisters cannot be manufactured using standard production machinery. In addition, both the case and the blister of the above-mentioned child-proof containers have a rather complex structure which negatively affects production and product costs.

In some embodiments, a third type of child-proof container is designed to include a box-shaped case having a storage which can be opened and closed by means of a closing system associated with the storage. The closing system carries a coupling portion adapted to cooperate, in the closed condition of the container, with a lock of the storage. In an embodiment, the closing system includes an aperture located at the coupling portion and configured to allow the user to reach manually (e.g., by means of a finger of a hand) the coupling portion. Such an aperture is closed by means of a removable tab. For example, the user, in order to open the container, must remove the tab and act directly on the coupling portion. This third type of child-proof containers has some drawbacks. The container, following an initial opening by an adult or following the removal of the removable tab, is no longer a child-proof container. In fact, following a first opening of the container, the coupling portion will be exposed and easily accessible by a child who can easily open the container. Additionally, the container has a rather complex structure which makes the container expensive and feasible only by means of specific production methods.

In some embodiments, a fourth type of child-proof container is designed to include a storage which can be opened and closed by means of a closing system associated with the storage. The closing system carries a coupling portion adapted to cooperate, in the closed condition of the container, with a respective coupling portion located inside the storage. In the closed condition of the container, the coupling portions of the closing system and of the storage are firmly engaged with each other within the latter. The closing system has a slit which allows the insertion of an opening device configured to disengage the coupling portions of the storage and of the closing system for opening the container. Unlike the embodiments described above, the container described herein has a simple and cost-effective structure, which can be manufactured using standard machinery. Moreover, the engagement of the coupling portions is reversible: following the opening of the container, the coupling portions can again be engaged within the storage and can be disengaged exclusively by means of the opening device which can be inserted through the slit. However, the fourth type of child-proof container has some drawbacks; for example, it does not have a closing system capable of signaling any tampering attempts.

In some embodiments, some containers for pharmaceutical products can be made by folding, starting from a flat blank in paper material. These containers have an anti-tamper seal at an aperture. The container exclusively describes a tamper-proof container totally devoid of a child-proof safety system. There continues to be a need for child-proof containers which can at the same time signal any attempts at tampering.

SUMMARY

The object of the present disclosure is to substantially solve the drawbacks and/or limitations of conventional containers.

A first object of the present disclosure is to provide a coupling system and a relative child-proof container having a stable structure capable of guaranteeing its integrity following multiple openings and closures, and simultaneously being tamper-proof. It is also an object of the present disclosure to provide a coupling system and a relative container having a simple and compact structure, which can be produced quickly and cost-effectively by means of standard type machinery. In particular, it is an object of the present disclosure to provide a coupling system and a container which do not require modification of the systems used for the production of standard type containers and which, furthermore, do not require modification of the existing packaging systems for filling the container itself.

These and yet other objects, which will become more apparent from the following description, are substantially achieved by a coupling system, a container, and a process for manufacturing the latter according to what is expressed in one or more of the accompanying claims and/or the following aspects, taken alone or in any combination with each other or in combination with any one of the appended claims and/or in combination with any of the other aspects or features described below. Aspects of the invention are described hereinafter.

In a 1st aspect, a tamper-evident child-proof coupling system (1) is provided, the coupling system includes:

- a first base portion (11),
- a first coupling portion (13) carried by the first base portion (11),
- a second base portion (12),
- a second coupling portion (14) carried by the second base portion (12), the first and second coupling portion (13, 14) being configured to define a priming condition of the coupling system (1) wherein the first and second coupling portion (13, 14) are engaged to each other, wherein the coupling system (1) further includes:

- at least one slit (15) defined on at least one among the first base portion (11) and the second base portion (12), wherein the slit (15) is configured to allow, optionally during the priming condition, the through-passing of at least one opening device (70) configured to allow the disengagement of the first and the second coupling portion (12, 13),
- a closing septum (50) which at least partly occludes the slit (15), the closing septum (50) being configurable between:
  - a first operative condition wherein the closing septum (50) at least partly occludes the slit (15) and hinders the through-passing of the opening device (70),
  - a second operative condition wherein at least part of the closing septum (50) is configured to take a different position with respect to the position taken by the closing septum (50) itself in the first operative condition to allow the through-passing of the opening device (70).

In a 2nd aspect, according to the 1st aspect, the closing septum (50) is configured for irreversibly passing from the first to the second operative condition following a first insertion of the opening device (70) through the slit (15) to signal a first attempt to open the coupling system (1), optionally to signal an attempt to tamper with the coupling system (1).

In a 3rd aspect, according to any one of the preceding aspects, wherein the closing septum (50), in the first operative condition, occludes at least 50%, optionally between 60% and 100%, of the passage section of the slit (15).

In a 4th aspect, according to any one of the preceding aspects, the slit (15) is configured to define a predetermined passage area, the closing septum (50), in the first operative condition, is configured to close the passage area by at least 50%, optionally between 60% and 100%.

In a 5th aspect, according to any one of the preceding aspects, wherein the passage defined through the slit (15), in the second operative condition of the closing septum, is greater than the passage defined through the slit (15), in the first operative condition of the closing septum (50).

In a 6th aspect, according to any one of the preceding aspects, the first base portion (11) is made of sheet material, optionally paper.

In a 7th aspect, according to any one of the preceding aspects, the second base portion (12) is made of sheet material, optionally paper.

In an 8th aspect, according to any one of the preceding aspects, the first coupling portion (13) is made of sheet material, optionally paper.

In a 9th aspect, according to any one of the preceding aspects, the second coupling portion (14) is made of sheet material, optionally paper.

In a 10th aspect, according to any one of the preceding aspects, the second coupling portion (14) includes at least one hook (22) defining at least one undercut portion delimited by a gripping edge (22*a*).

In an 11th aspect, according to any one of the preceding aspects, the first coupling portion (13) includes at least one respective hook (23) defining at least one undercut portion delimited by a respective gripping edge (23*a*), the hooks (22, 23) of the first and second coupling portions (13, 14), being configured for stably engaging with each other during the priming condition of the coupling system (1).

In a 12th aspect, according to the preceding aspect, the hooks (22, 23) of the first and second coupling portion (13, 14), in the priming condition of the coupling system (1), have respective concavities facing each other.

In a 13th aspect, according to any one of the preceding aspects, the first coupling portion (13) extends in prolongation of the first base portion (11).

In a 14th aspect, according to any one of the preceding aspects, the first base portion (11) and the first coupling portion (13) are joined together in a single piece.

In a 15th aspect, according to any one of the aspects 6th to 10th, the second coupling portion (14) includes a base body (25) directly carrying the hook (22), the base body (25) including a mutual coupling portion (17) overlapped and stably constrained to a respective mutual coupling portion (18) of the second base portion (12).

In a 16th aspect, according to the preceding aspect, the hook (22) of the second coupling portion (14) extends in prolongation of the base body (25) of the same second coupling portion (14), the hook (22) of the second coupling portion (14) being overlapped and moveable relatively to the second base portion (12).

In a 17th aspect, according to the 15th or 16th aspect, the mutual coupling portions (17, 18) of the second coupling portion (14) and of the second base portion (12), respectively, are fixed together by means of adhesive material.

In an 18th aspect, according to any one of the aspects 15th to 17th, the hook (22) of the second coupling portion (14) is constrained to the second base portion (25) exclusively by means of the base body (25) of the second coupling portion (14).

In a 19th aspect, according to any one of the aspects 15th to 18th, the hook (22) of the second coupling portion (14) is moveable by rotation relative to the base body (25) of the same second coupling portion (14) between:

a first operative position in which the hook (22) extends in prolongation and parallel to the base body (25) of the second coupling portion (14), the hook—in the first operative position—being faced and arranged parallel to the second base portion (12), and a second operative position in which the hook (22) is arranged transversely with respect to the base body (25) of the second coupling portion (14) and with respect to the second base portion (12).

In a 20th aspect, according to any one of the aspects 15th to 19th, the hook (22) and the base body (25) of the second coupling portion (14) delimit an opening (14*a*) configured to allow the through-passing of the first coupling portion (13) and the engagement of the hook (23) thereof with the hook (22) of the second coupling portion (22) for defining the priming condition.

In a 21st aspect, according to the preceding aspect, the hook (22) of the second coupling portion (14), in the second operative position, delimits said opening (14*a*) configured to allow the through-passing of the first coupling portion (13).

In a 22nd aspect, according to any one of the preceding aspects, the second coupling portion (14), in the priming condition of the coupling system (1), is at least partly interposed between the second base portion (12) and the first coupling portion (13).

In a 23rd aspect, according to any one of the preceding aspects, the second base portion (12) and the second coupling portion (14) are joined together in a single piece.

In a 24th aspect, according to any one of the preceding aspects, the second base portion (12) and the second coupling portion (14) are obtained by folding a single sheet, optionally of paper material.

In a 25th aspect, according to any one of the preceding aspects, the first coupling portion (13) is stably constrained, optionally joined in a single piece, to the first base portion (11), wherein between the first coupling portion (13) and the first base portion (11) weakened portions are not present.

In a 26th aspect, according to any one of the preceding aspects, the second coupling portion (14) is stably constrained, optionally joined in a single piece, to the second base portion (12), wherein between the second coupling portion (14) and the second base portion (12) weakened portions are not present.

In a 27th aspect, according to any one of the aspects 15th to 26th, wherein there are no weakening portions between the hook (22) of the second coupling portion (14) and the base body (25).

In a 28th aspect, according to any one of the preceding aspects, the coupling system (1) includes at least one recess (29) defined on the second base portion (12) which is configured to allow, in the priming condition of the coupling system (1), the visualization of at least part of the first coupling portion (13).

In a 29th aspect, according to any one of the preceding aspects, the slit (15) is defined, optionally exclusively, on the first base portion (11).

In a 30th aspect, according to any one of the preceding aspects, the closing septum (50) includes at least one of:

a tab (50*a*) arranged inside the slit (15) and engaged to the first base portion (11) by means of a weakened portion configured to allow the separation, optionally irreversible, of the tab (50*a*) from the first base portion (11) following a first insertion of the opening device (70) through the slit (15), a membrane (50*b*) arranged at the slit (15) and configured to break, optionally irreversibly, following a first insertion of the opening device (70) through the slit (15).

In a 31st aspect, according to any one of the preceding aspects, the coupling system (1) includes an opening device (70) configured for being inserted, at least in the priming condition of the coupling system (1), at least partially through said slit (15) to allow the disengagement between the first and second coupling portion (13, 14), optionally the separation between the first and the second base portion (11, 12).

In a 32nd aspect, according to the preceding aspect, the opening device (70) is configured to pass through the slit (15) and be interposed between the first and the second coupling portion (13, 14) so as to allow the disengagement thereof.

In a 33rd aspect, according to the 31st or 32nd aspect, the opening device (70) includes a tab made of sheet material, optionally made of paper sheet material, configured for damaging the closing septum (50) of the coupling system (1) during the thrust thereof through the slit (15).

In a 34th aspect, according to any one of the preceding aspects, the first and second base portions (11, 12) are configured for switching from the priming condition, in which they are engaged to each other by means of the first and second coupling portion (13, 14), to a separation condition exclusively following the insertion of the opening device (70) through the slit (15), optionally interposed between said first and second coupling portion (12, 13).

In a 35th aspect, according to any one of the preceding aspects, the coupling system (1) includes at least one tamper-evident coating (52) associated, optionally with the sheet material, to at least one between the first and second coupling portions (13, 14), said tamper-evident coating (52) at least partially coating at least one between the first and the second coupling portion (13, 14), wherein said tamper-evident coating (52) is configured for visually signaling, following a scraping stress of the coating itself, an attempt to tamper of the coupling system (1).

In a 36th aspect, according to the preceding aspect, wherein the coating at least partially covers the sheet material of at least one between the first and second coupling portion (13, 14) on the side facing, in the priming condition of the coupling system (1), towards the second base portion (12).

In a 37th aspect, according to the 35th or 36th aspect, wherein the tamper-evident coating (52) covers, on the side facing the second base portion, the sheet material of the first coupling portion (13), wherein the ratio between the surface extension of the tamper-evident coating (52) applied on said first coupling portion (13) and the overall extension of the surface of the first coupling portion (13) on which said coating is applied is greater than 0.1, optionally it is equal to or between 0.2 and 1.

In a 38th aspect, according to the 35th or 36th or 37th aspect, wherein the tamper-evident coating (52) covers, on the side facing the second base portion (12), the sheet material of the second coupling portion (14), wherein the ratio between the surface extension of the tamper-evident coating (52) applied on the second coupling portion (14) and the overall extension of the surface of the second coupling portion (14) on which said coating is applied is greater than 0.1, optionally it is equal to or between 0.2 and 1.

In a 39th aspect, according to any one of the aspects 35th to 38th, the tamper-evident coating (52) includes:

a support substrate (52*a*) directly constrained to the sheet material of at least one between the first and the second coupling portion (13, 14), a removable layer (52*b*) superimposed to the support substrate (52) so that said support substrate (52*a*) is interposed between the removable layer (52*b*) and the sheet material to which the support layer (52*a*) is constrained directly, wherein the support layer (52*a*) is configured to generate a force for adhesion with the sheet material of at least one between the first and the second coupling portion (13, 14) greater than the force for adhesion with the removable layer (52*b*).

In a 40th aspect, according to the preceding aspect, the removable layer (52*b*) has a different colouration than the colouration of the support layer (52*a*), optionally of the colouration of the sheet material to which the support layer (52*a*) is directly constrained.

In a 41st aspect, according to the preceding aspect, the tamper-evident coating (52), following a scraping stress on at least part of the removable layer (52*b*), being configured to generate a change of colouration of the coating (52) representing an attempt to tamper with the coupling system (1).

In a 42nd aspect, according to the 40th or 41st aspect, the tamper-evident coating (52) is configured to show, following a scraping stress on at least a part of the removable layer (52*b*), at least part of the support substrate (52*a*), optionally of the sheet material to which the coating (52) is directly constrained.

In a 43rd aspect, according to any one of the preceding aspects, the tamper-evident coating (52) completely covers the first coupling portion (13) on one side facing, in the priming condition of the coupling system (1), towards the second base portion (12).

In a 44th aspect, according to any one of the aspects 35th to 43rd, the tamper-evident covering (52) covers, optionally entirely, the hook (22) of said second hooking portion on a side facing, in the priming condition of the coupling system (1), towards the second base portion (12).

In a 45th aspect, according to any one of the aspects 39th to 44th, the support substrate (52*a*) includes a paint.

In a 46th aspect, according to the preceding aspect, said paint includes at least one filmogenous polymer or monomers and/or precursor oligomers thereof.

In a 47th aspect, according to the preceding aspect, said monomers and/or oligomers give rise to the filmogenous polymer by cross-linking following the irradiation thereof with a UV light.

In a 48th aspect, according to the 45th or 46th or 47th aspect, said paint includes a mixture of filmogenous polymers.

In a 49th aspect, according to any one of the aspects from 45th to 48th, said paint includes at least one silicone resin and at least one polymer selected from acrylic resins, alkyd resins, polyester resins, vinyl resins and phenolic resins.

In a 50th aspect, according to any one of aspects 46th to 49th, said polymer is a thermoplastic polymer:

In a 51st aspect, according to any one of the aspects 46th to 50th, said polymer is selected from acrylic, alkyd, polyester, vinyl, phenolic, and silicone resins.

In a 52nd aspect, according to any one of the aspects 39th to 51st, the removable layer (52*b*) includes an ink.

In a 53rd aspect, according to the preceding aspect, the ink includes at least one filmogenous polymer or monomers and/or precursor oligomers thereof and a pigment.

In a 54th aspect, according to the 52nd or 53rd aspect, the ink includes monomers and/or precursor oligomers of the filmogenous polymer, optionally giving rise to the thermoplastic polymer by cross-linking following irradiation thereof with a UV light.

In a 55th aspect, according to the 53rd or 54th aspect, said pigment is a metallic pigment, optionally including an aluminum powder.

In a 56th aspect, according to any one of the aspects 53rd to 55th, the filmogenous polymer is a thermoplastic polymer, optionally an acrylic resin.

In a 57th aspect, is provided a child-proof and tamper-proof container (100) including:

a storage (2) defining an internal volume (3) configured to house at least one product, said storage (2) having a predetermined number of lateral walls (4) defining a passage opening (5) delimited by a free edge (6) and configured to put the internal volume (3) of the storage (2) in communication with the external environment, at least one coupling system (1) according to any one of the preceding aspects, wherein the first base portion (11) of the coupling system (1) is constrained to the free edge (6) of the storage (2) and moveable, optionally by rotation, relatively to the storage (2) at least between:

a closing position in which at least part of the first base portion (11) prevents the communication between the internal volume (3) of the storage (2) and the external environment, an opening position in which the first base portion (11) allows the communication between the internal volume (3) and the external environment, wherein, in the closing position of the first base portion (11), the first and the second coupling portion (13, 14) of the coupling system (1) are mutually engaged to define said priming condition.

In a 58th aspect, according to the preceding aspect, the first coupling portion (13) extends in prolongation of the first base portion (11) on the opposite side to the storage (2).

In a 59th aspect, according to the 57th or 58th aspect, the second base portion (12) of the coupling system (1) defines at least part of the lateral wall (4) of the storage (2), while the second coupling portion (14) is at least partially disposed in the internal volume (3) of the storage (2).

In a 60th aspect, according to any one of the aspects 57th to 59th, the slit (15) of the coupling system (1) is configured for allowing the insertion of an opening device (70) in the internal volume (3) of the storage (2) for the disengagement of the first and second coupling portion (13, 14) and the consequent switching of the closing system from the closed position to the open position.

In a 61st aspect, according to any one of the aspects 57th to 60th, the first coupling portion (13) is carried by the first base portion (11) so that the latter is interposed, in the priming condition of the coupling system (1) and therefore during the closing position of the first base portion (11), between the free edge (6) of the storage (2) and the first coupling portion (13).

In a 62nd aspect, according to any one of the aspects 57th to 61st, the first coupling portion (13), in the priming condition of the coupling system (1) and therefore during the closing position of the first base portion (11), is entirely arranged in the internal volume of the storage.

In a 63rd aspect, according to any one of the aspects 57th to 62nd, the base body (25) and the hook (22) of the second coupling portion (14) are internally arranged in the internal volume (3) of the storage (2), wherein the first coupling portion (13) of the coupling system (1), in the closed position of the first base portion (11), being arranged internally in the storage (2) of the container.

In a 64th aspect, according to any one of the aspects 57th to 63rd, the first base portion (11) includes:

a closing portion (7) directly engaged with the free edge (6) of the storage (2) and moveable, optionally by rotation, with respect to the latter, at least one insertion portion (8) configured for being inserted, in the closed position, in the internal volume (3) of the storage (2), the first coupling portion (13) extending in prolongation of the insertion portion (8) on the opposite side with respect to the storage (2).

In a 65th aspect, according to the preceding aspect, the closing portion (7) of said base portion (11), in the closing position of the first base portion (11), occludes at least in part the passage opening (5) of the storage (2).

In a 66th aspect, according to the 64th or 65th aspect, the insertion portion (8), in the closed position of the first base portion (11), is arranged in the internal volume of the storage (2) facing, optionally at least partly in contact with, the lateral wall (4) of the storage (2) directly constrained to the base body (25) of the second coupling portion (14).

In a 67th aspect, according to any one of the aspects 57th to 66th, the tamper-evident coating (52) covers at least in part at least one between the first and second coupling portion (13, 14), facing towards the outside of the container (1).

In a 68th aspect according to any one of the aspects 64th to 67th, the tamper-evident coating (52) covers at least part of the insertion portion (8) on the side facing, in the closed position of the container (100), towards the outside, optionally towards the lateral wall (4) of the storage directly constrained to the base body (25) of the second coupling portion (14).

In a 69th aspect, according to the preceding aspect, wherein the ratio between the surface extension of the tamper-evident coating (52) placed on the insertion portion (8) and the overall extension of the surface of the insertion portion (8) on which said coating (52) is associated, said second coupling portion (14) is greater than 0.1, optionally equal to or between 0.2 and 1.

In a 70th aspect, according to any one of the aspects 57th to 69th, wherein the second coupling portion (14) develops substantially parallel with respect to a lateral wall (4) of the container (1), optionally develops parallel to the lateral wall (4) of the storage (2) opposite to the lateral wall directly constrained to the first base portion (11).

In a 71st aspect, according to any one of the aspects 57th to 70th, the opening device (70) includes a sheet element having a gripping portion (71) from which at least one appendage (72) emerges, configured for being inserted at least in part inside the slit (15), optionally said appendage (72) is configured for interposing, at least in the priming position of the coupling system (1), between the first and the second coupling portion (13, 14).

In a 72nd aspect, according to any one of the aspects from 64th to 71st, the slit is defined on the closing portion (7) of the first base portion (11).

In a 73rd aspect, is provided a process of making a coupling system according to any one of the aspects from 1st to 56th, said process including the following steps:

providing a first flat sheet (51), cutting said first flat sheet (51) to define the first base portion (11), the first coupling portion (13), the slit (15) and the closing septum (50), providing a second flat sheet (53), cutting said second sheet (53) to define at least said second base portion (12) and the second coupling portion (14) to the second base portion (12).

In a 74th aspect, according to the preceding aspect, the process includes the following steps:

cutting said second sheet (53) to define a first portion and a second portion (53*a*, 53*b*), folding the second portion (53*b*) of the second sheet over the first portion (53*a*) so that the latter can define the second base portion (12) while the first portion (53*a*) of the second sheet (53) can define the second coupling portion (14), constraining, optionally by gluing, the second coupling portion (14) to the second base portion (12).

In a 75th aspect, according to the 73rd or 74th aspect, the process including at least one of the following steps:

applying the tamper-evident coating (52) on at least part of the first sheet (51), prior to the cutting step of the same sheet, applying the tamper-evident coating (52) on at least part of the sheet of the first coupling portion (13), after the cutting step of the first sheet (51), applying the tamper-evident coating (52) on at least part of the second sheet (53), prior to the cutting step of the same sheet, applying the tamper-evident coating (52) on at least part of the sheet of the second coupling portion (14), after the cutting step of the second sheet (53).

In a 76th aspect, according to the preceding aspect, the step of applying the tamper-evident coating (52) further includes the following sub-steps:

applying a support substrate (52*a*) on the respective sheet, applying a removable layer (52*b*) on the support substrate (52*a*).

In a 77th aspect, according to the 75th or 76th aspect, the step of applying the tamper-evident coating (52), optionally the support substrate (52*a*) and/or the coating layer (52*b*), occurs by means of at least one of the following processes: digital printing, flexographic printing, letterpress printing, flexopress printing, planographic printing, ink jet printing.

In a 78th aspect, according to any one of the aspects 73rd to 77th, the step of cutting the first and/or second sheet (51, 53) includes at least one operation between the following processes: punching, die-cutting, engraving, shearing, laser cutting.

In a 79th aspect, according to any one of the aspects 73rd to 78th, the first and the second sheet (51, 53) are made of paper sheet material.

In an 80th aspect, a process is provided for making a container (100) according to any one of the aspects 57th to 72nd, said process including at least the following steps:

preparing the storage (2), preparing the coupling system (1) so that:

the first base portion (11) and the first coupling portion are borne by the free edge (6) of the storage (2) and are movable in rotation with respect to the latter, the second base portion (12) defines at least part of a lateral wall (4) of the storage, the second coupling portion (14) is arranged at least partly in the internal volume (3) of the storage (2).

In an 81st aspect, according to the preceding aspect, the step of arranging the storage (2) includes at least the following sub-steps:

arranging a third sheet (56) including at least one first and one second portion (57, 59) interconnected by a central connecting portion (58), said third sheet (56) further including at least one first and one second lateral connecting portion (60, 61), said central connecting portion (58) being interposed between the first and the second portion (57, 59), the first portion (57) being interposed between the first lateral connecting portion (61) and the central connecting portion (58), the second portion (59) being interposed between the second lateral connecting portion (60) and the central connecting portion (58), each of said portions (57, 58, 59, 60, 61) including at least two opposite longitudinal edges and two opposite end edges, said first and second portions (57, 59), central connecting portion (58) and said lateral connecting portions (60, 61) being joined along the longitudinal edges and aligned along a single connection direction, folding said third sheet (56), joining said lateral connecting portions (60, 61), to form the storage (2) exhibiting the passage opening (5) delimited by the free edge (6), In an 82nd aspect, according to the preceding aspect, the second sheet (53) defining the second base portion (12) of the coupling system (1) is joined in a single piece to form a single body with the first portion (57) of the third sheet (56).

In an 83rd aspect, according to the 81st or 82nd aspect, the first sheet (51) defining the first base portion (11) of the coupling system (1) is joined in a single piece to form a single body with the second portion (59) of the third sheet (56), optionally said first sheet (51) emerges from the longitudinal edges of the third sheet (56).

In an 84th aspect, is provided a use of a coupling system (1) according to any one of the aspects from the 1st to the 56th for defining at least one selected from the group of: a container for containing one or more products, an envelope for containing one or more products, a wrapping band of one or more products.

BRIEF DESCRIPTION OF THE DRAWINGS

Some embodiments and some aspects of the disclosure are described hereinafter with reference to the accompanying drawings, provided only for illustrative and, therefore, non-limiting purposes, in which:

FIGS. 1 and 2 are front views of a portion of a coupling system according to the present disclosure shown in an extended condition (FIG. 1) and a folded condition (FIG. 2), respectively;

FIGS. 3 and 4 are views of respective embodiments of a further portion of the coupling system according to the present disclosure;

FIGS. 12 and 13 are further views of a portion of a coupling system according to the present disclosure shown in an extended condition (FIG. 12) and a folded condition (FIG. 13), respectively;

FIGS. 14 and 15 are views of respective embodiments of a further portion of the coupling system according to the present disclosure;

DETAILED DESCRIPTION

Figure 5:
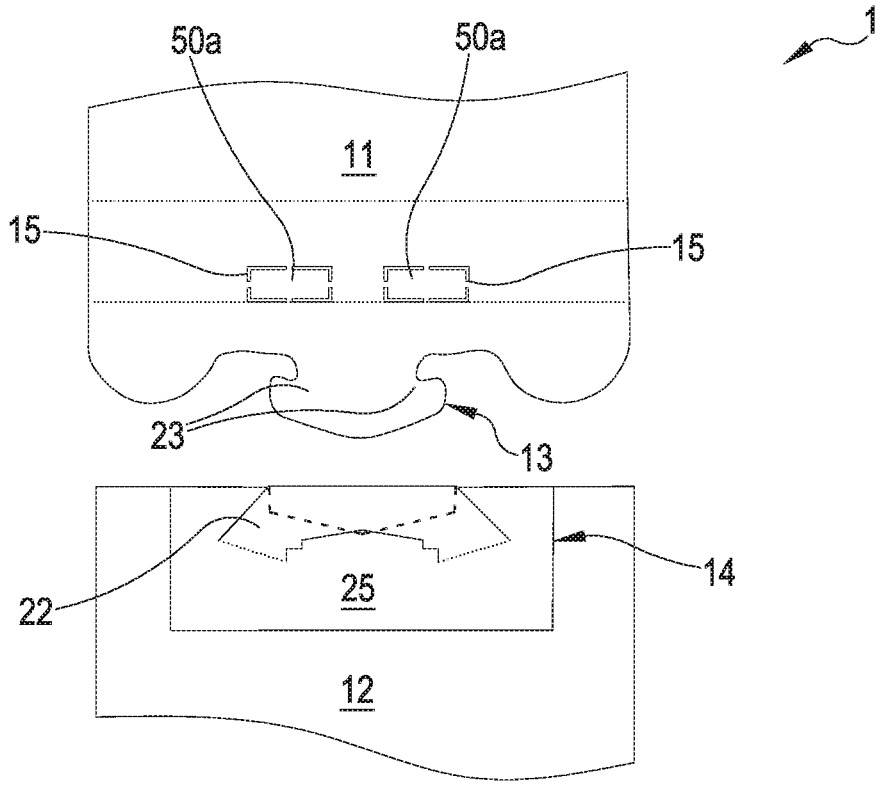
FIG. 5 is a schematic view of a coupling system according to the present disclosure arranged in a condition prior to a first priming condition.
Figure 6:
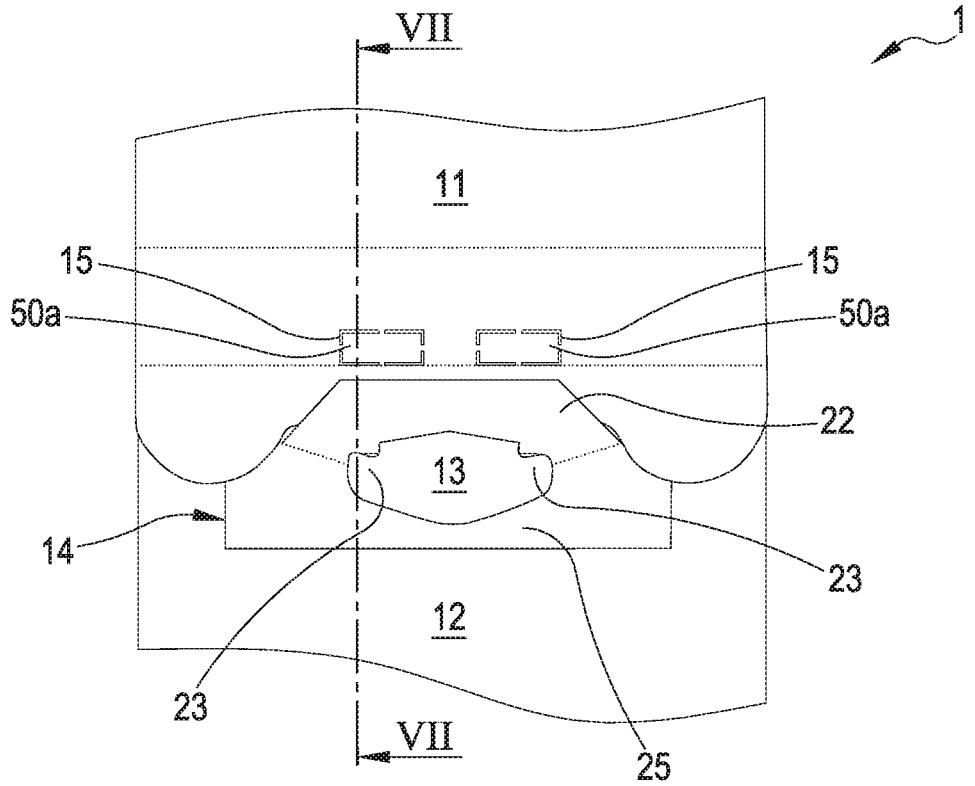
FIG. 6 is a schematic view of a coupling system according to the present disclosure arranged in a priming condition.

The figures may illustrate the object of the invention by representations that are not in scale; therefore, parts and components illustrated in the figures relating to the object of the invention may relate solely to schematic representations.

By the term product it is instead meant an article or a mixture of articles of any kind. For example, the product may be a drug or medicine in solid or liquid form or in the form of gel, or in the form of two or more of the above aggregation states. The product may also be understood as a package, for example a blister, carrying a plurality of items.

The term "paper material" means paper or cardboard, for example having at least 50% by weight, optionally at least 70% by weight, of organic material including one or more of cellulose, hemicellulose, lignin, and lignin derivatives. The paper material may be in sheet material having a basis weight of between 100 and 500 g/m$^2$. The paper sheet material may be at least partly covered by a plastic coating, for example a film, the purpose whereof is to: reinforce the paper sheet material, define a barrier to water and/or moisture. The coating may have a variable thickness of between 10 and 50 μm and may be made with one or more of the following materials: low-density polyethylene (LDPE), high-density polyethylene (HDPE), polypropylene (PP), and polyethylene (PE).

With reference to the present disclosure, the term "blank" refers to a flat semi-finished product in sheet material, for example made of paper sheet material, which can be folded onto itself to make a container. The blank may be in single piece and may be obtained by cutting a single sheet.

The term "sheet material" means a material that has two dimensions, for example the length and the width, significantly greater than a third dimension such as the thickness, for example.

The term "adhesion" means the physical attraction or joining of two materials of different nature placed in contact. Adhesion describes the fixing strength to a surface.

The term "scraping stress" means a tangential mechanical stress applied superficially on a body, for example, on the tamper-evident coating 52.

Coupling System 1

Reference numeral 1 overall indicates a tamper-evident child-proof coupling system of sheet material, for example, of paper material, associable to packages of various kinds (e.g., containers, envelopes, or bands also made of sheet material) for the containment and/or wrapping of products.

The coupling system 1 includes a first base portion 11 made of sheet material stably carrying a first coupling portion 13 of the system 1. In detail, the first coupling portion 13 is engaged at an end portion of the first base portion 11: such portions 11 and 13 are reciprocally engaged to essentially define a single peripheral edge.

The first coupling portion 13 may be joined in a single piece to the first base portion 11 and extend in prolongation, without interruption, with respect to said first base portion 11: the first base portion 11 and the first coupling portion 13 are joined to form a single body. In fact, the first base portion 11 and the first coupling portion 13 are made of the same sheet material, for example paper. The first coupling portion 13 is stably constrained to the first base portion 11 so as to define a single piece without weakened portions. In fact, weakened portions such as, for example, notches or thickness reductions, adapted to favor the separation between the two portions in the event of stress are absent between the first base portion 11 and the first coupling portion 13. To maximize the resistance, the two portions 11, 13 are in a single body without such weakening so as to prevent the breakage thereof. In the case of portions 11, 13 made of paper sheet material, the same may provide a coating in plastic material configured to reinforce the sheet and improve the mechanical features thereof. The sheet of the two portions may be coated only on one side or it may have a double coating so that the paper sheet material is interposed between two films of reinforcing plastic material.

As shown, for example, in FIGS. 3-6, 14, 15, the first coupling portion 13 includes at least one hook 23 defining at least an undercut portion delimited by a respective gripping edge 23*a*. The first coupling portion 13 may exhibit two respective hooks 23, symmetric to each other with respect to an axis passing by the centerline of the first coupling portion 13: the two hooks define two respective gripping edges 23*a*. In the accompanying figures, a first coupling portion 13 is shown having an arrow or trapezoidal shape. The possibility of manufacturing a first coupling portion 13 exhibiting a different shape, for example triangular or rectangular, is not excluded.

The coupling system 1 further includes a second base portion 12 made of sheet material stably carrying a second coupling portion 14. As can be seen, for example, in FIGS. 2, 7-9 and 13, the second coupling portion 14 is overlapped and at least partly facing the second base portion 12. In particular, the second base portion 12 and the second coupling portion 14 are joined in a single piece to form a single body having a single peripheral edge at respective end portions. As shown schematically in FIGS. 1 and 12 and as will be described in greater detail below, the portions 12 and 14 are obtained by folding two portions of a single sheet 53. The second coupling portion 14 is joined in a single piece to an end portion of the second base portion 12 and folded over the latter so that said second coupling portion 14 faces the second base portion 12. In fact, weakened portions such as, for example, notches or thickness reductions, adapted to favor the separation between the two portions 12, 14 in the event of stress are absent between the second base portion 12 and the second coupling portion 14. Conversely, the two portions 12, 14 are in a single body without such weakening so as to prevent the breakage thereof. In the case of portions 12, 14 made of paper sheet material, the same may provide a coating in plastic material configured to reinforce the sheet and improve the mechanical features thereof. The sheet of the two portions 12, 14 may be coated only on one side or it may have a double coating so that the paper sheet material is interposed between two films of reinforcing plastic material.

Figure 7:
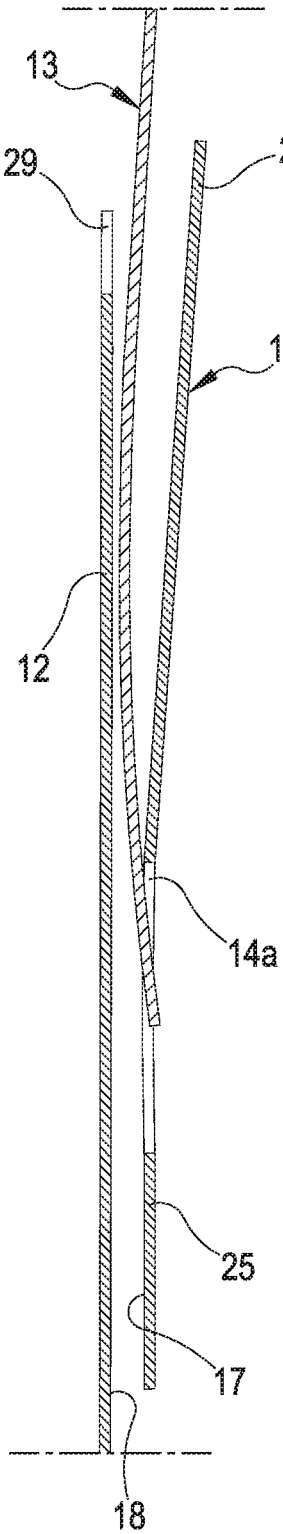
FIG. 7 is a detailed sectional view of a coupling system during the priming step.
Figure 8:
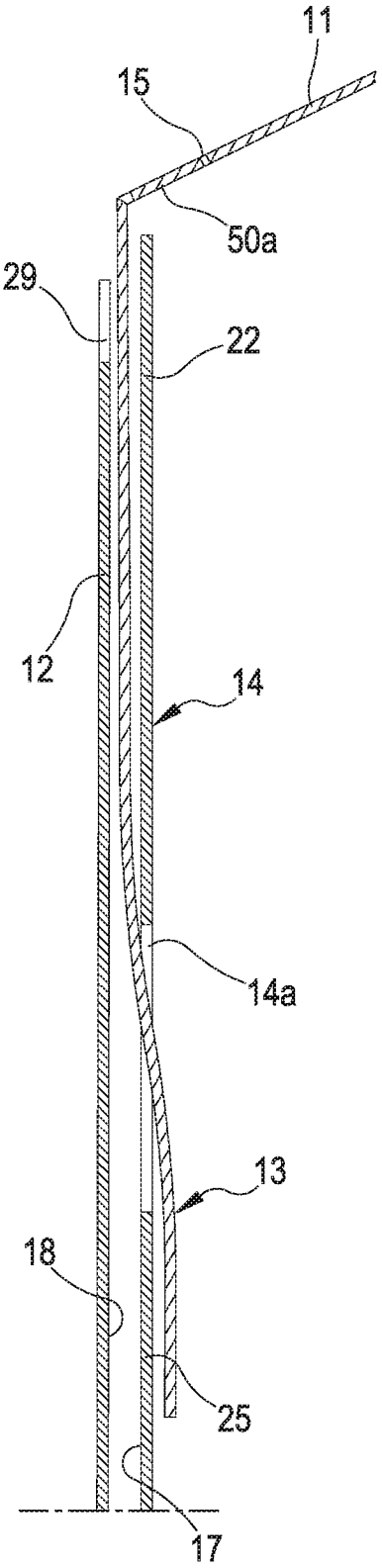
FIGS. 8 and 9 are detailed sectional views of different embodiments of a coupling system in priming condition.
Figure 9:
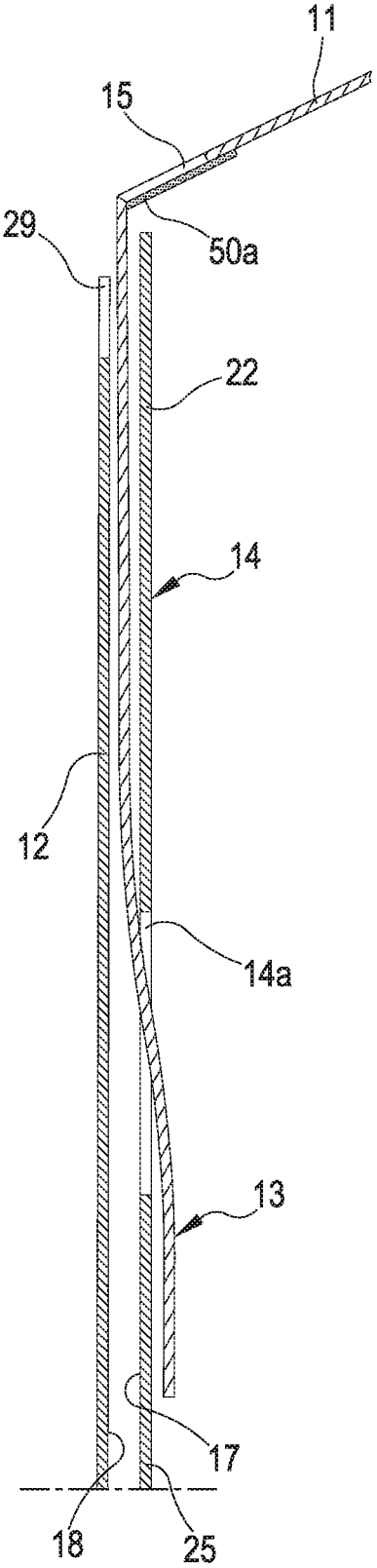
Figure 10:
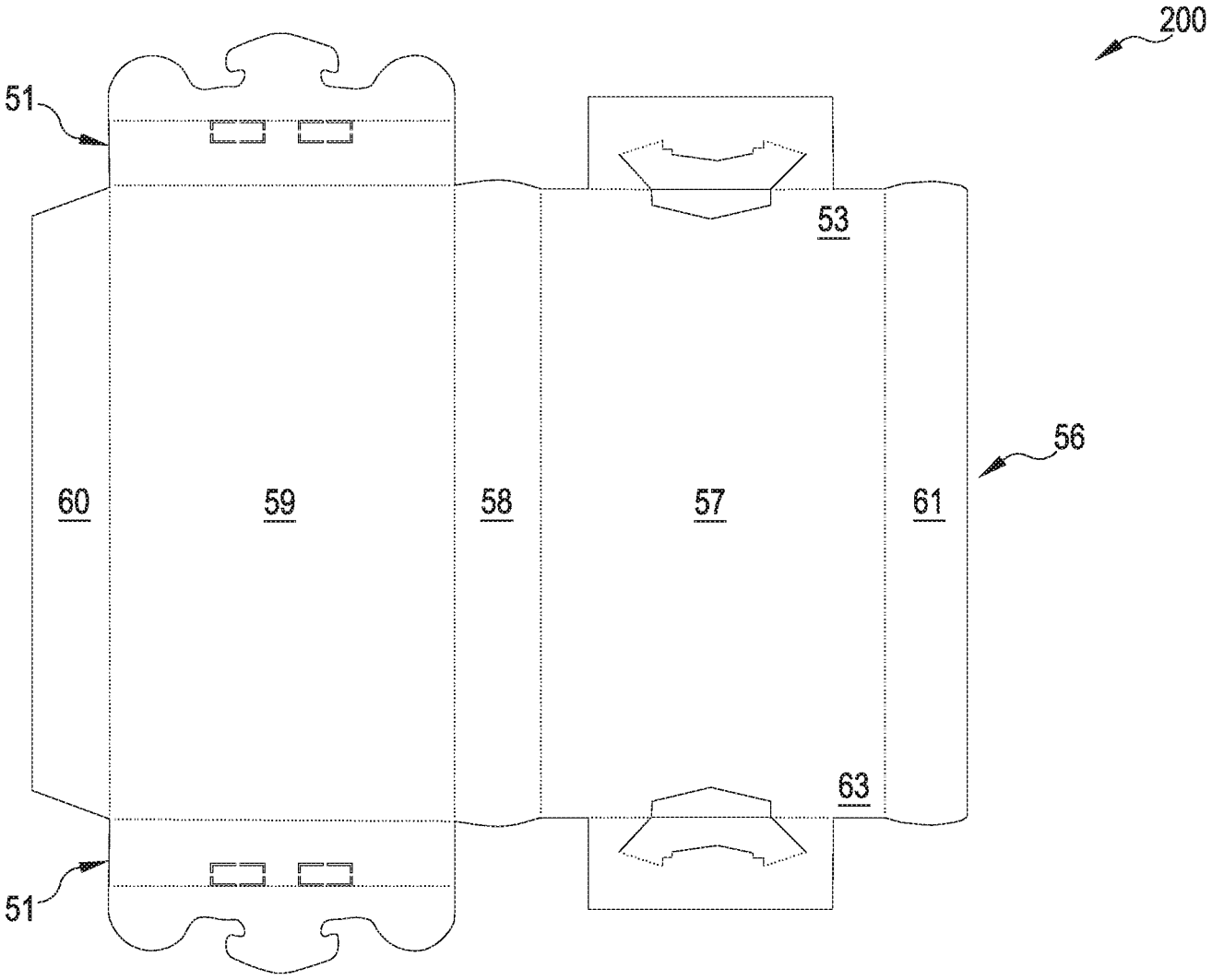
FIGS. 10 and 11 are top views of respective blanks for making a container including at least one coupling system according to the present disclosure.
Figure 11:
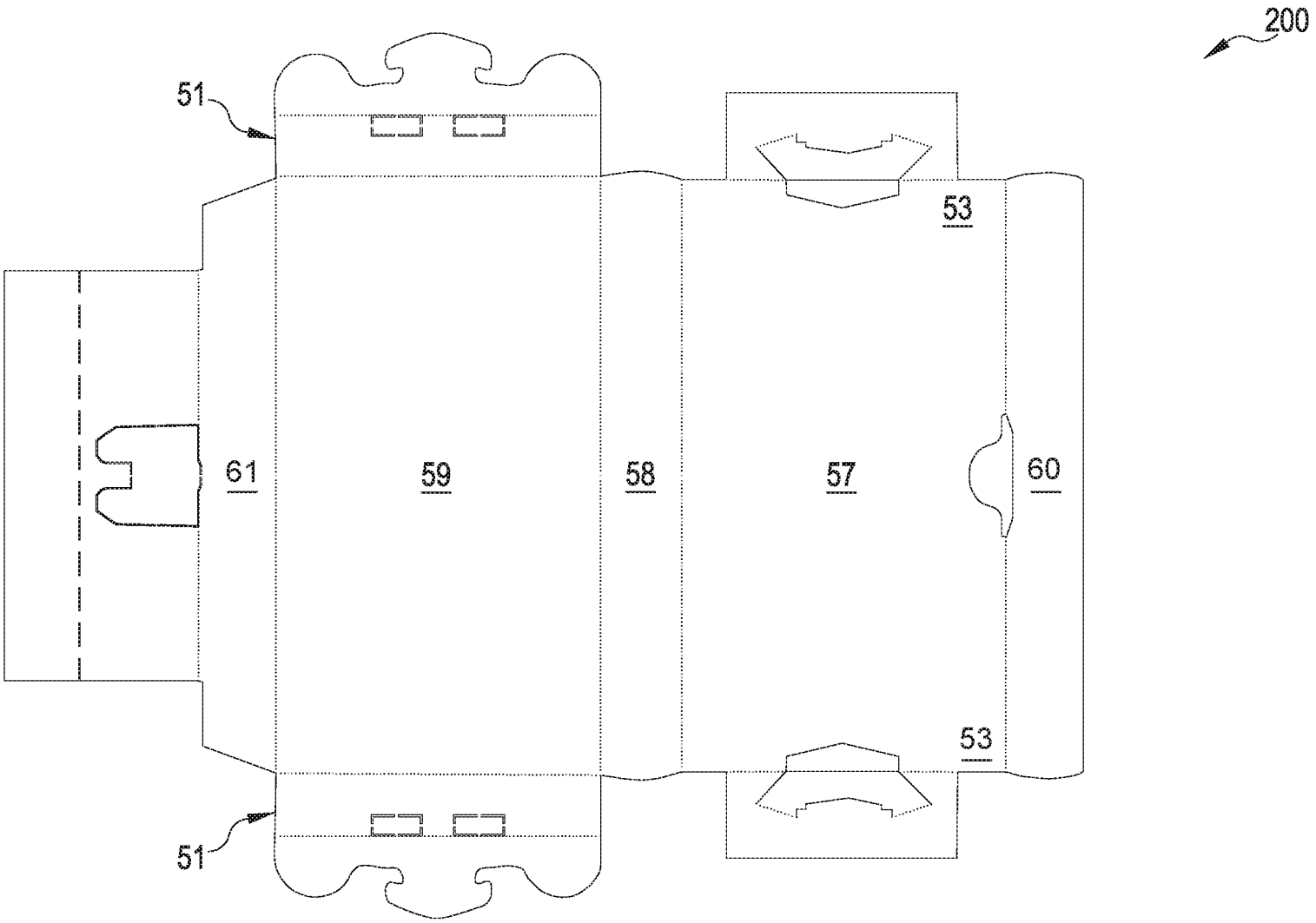
Figure 16:
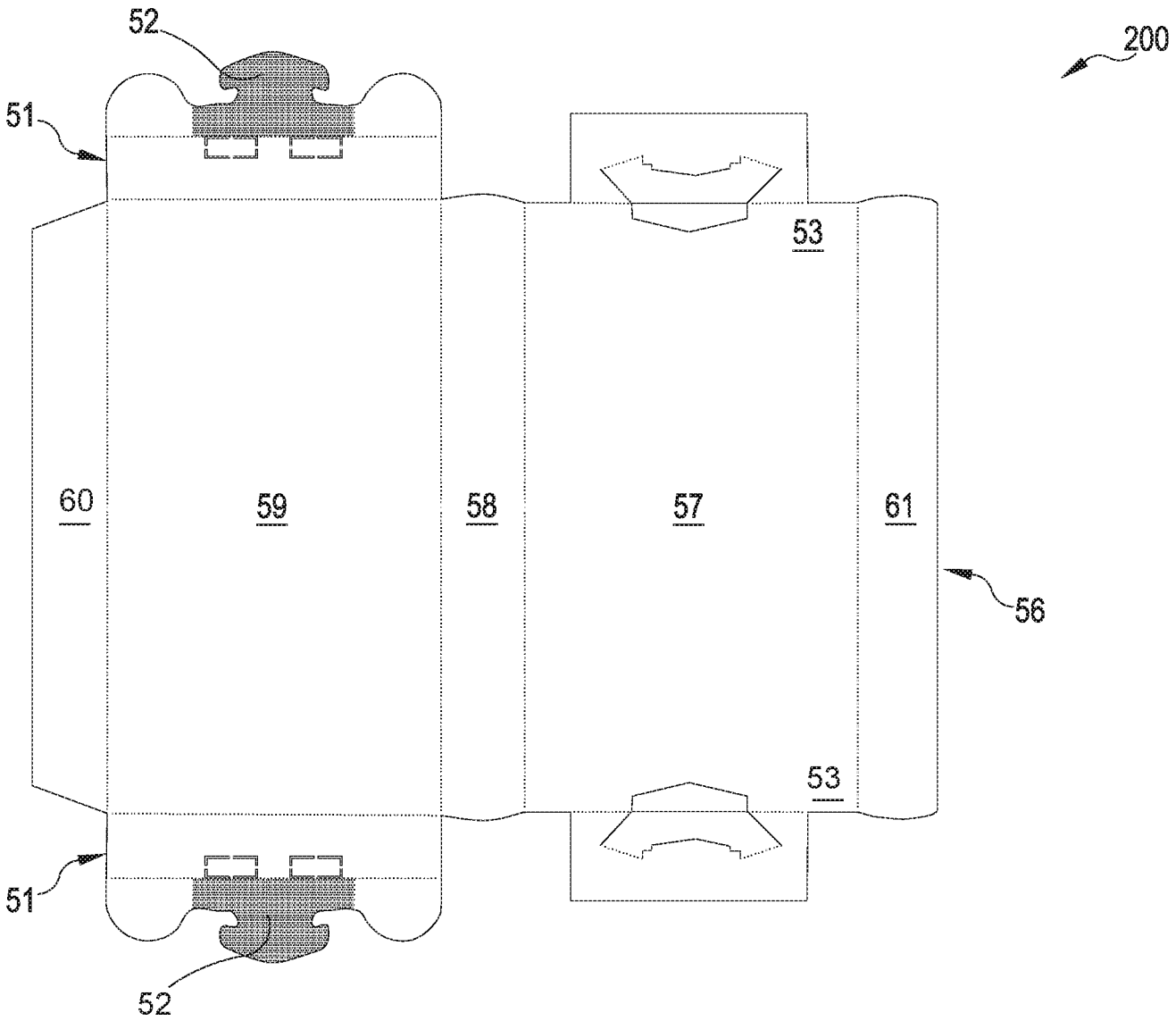
FIG. 16 is a top view of a further blank for making a container including at least one coupling system according to the present disclosure.

In greater detail, the second coupling portion 14 includes a base body 25 including a mutual coupling portion 17 overlapped and stably constrained to a respective mutual coupling portion 18 of the second base portion 12. FIGS. 7-9 schematically show the mutual coupling surfaces 17 and 18 which, for simplicity and to be clearly identified, have been illustrated spaced apart and separated: these portions are however in direct contact and firmly constrained to each other by means of adhesive portions, for example glue.

The base body 25 directly carries at least one hook 22 extending in prolongation of the base body 25. Even between the hook 22 and the base body 25 there are weakened portions, such as for example notches or thickness reductions, adapted to favor the separation between said elements (hook 22 and base body 25) in case of stress. To maximize the mechanical strength, the hook 22 and the base body 25 are in a single body without such weakening so as to prevent the breaking thereof. If the hook 22 and the base body 25 are made of paper sheet material, these can provide a coating of plastic material configured to reinforce the sheet and improve the mechanical features thereof: this sheet may be coated on one side only or it may have a double coating so that the paper sheet material is interposed between two films of reinforcing plastic material.

The hook 22, unlike the base body 25, is movable, optionally by rotation, relative to the second base portion 12. In fact, the hook 22 of the second coupling portion 14 is constrained to the second base portion 12 exclusively by means of the base body 25 of the second coupling portion 14. Due to the absence of a direct constraint with the second base portion 12, the hook 22 is moveable relative to said base portion 12 at least between:

- a first operative position, in which said hook 22 extends in prolongation and parallel to the base body 25 of the second coupling portion 14. The hook 22, in the first operative position, is facing and arranged parallel to the second base portion 12; and
- a second operative position in which the hook 22 is inclined with respect to the base body 25 of the second coupling portion 14 and with respect to the second base portion 12.

In detail, the hook 22 has a substantially "C" or "V" shape defining at least one undercut portion delimited by a gripping edge 22*a*, the latter having a substantially "V" shape, optionally a "C" shape the concavity whereof faces the base body 25.

As can be seen in FIGS. 7-9, the hook 22 and the base body 25 of the second coupling portion 14 cooperate with each other to delimit an opening 14*a* configured to allow the through-passing of the first coupling portion 13 to allow the engagement thereof with the second coupling portion as will be described below. In particular, the hook 22 of the second coupling portion 14 delimits said opening 14*a* when arranged in the second operative position; in greater detail, such an opening 14*a* is delimited by the gripping edge 22*a* of the hook 22 in cooperation with a peripheral edge of the gripping body.

The first and second coupling portion 13, 14 are configured to define at least one priming condition of the coupling system 1 wherein said first and second coupling portion 13, 14 are engaged to each other. In the priming condition, also the first and second base portions 11, 12 are stably constrained to each other. In the priming condition of the coupling system, the hooks 23 and 22 of the first and second coupling portion 13, 14, respectively, are configured for stably engaging with each other: the hooks 22 and 23, in said priming condition, have the respective concavities facing each other. In detail, the gripping edge 22*a* of the hook 22 and the respective gripping edges 23*a* of the respective hook 23 are configured for stably engaging with each other during the priming condition of the coupling system 1.

The coupling step of the hooks 22, 23, takes place by means of an initial contact condition between the first and second coupling portion 13, 14; the first coupling portion 13 is inserted in interposition between the hook 22 of the second coupling portion 14 and the second base portion 12 (FIG. 7): in this condition, the first coupling 13 portion is made to slide onto the hook 22. Thereafter, the first coupling portion 13 is pushed below the second coupling portion 14, through the opening 14*a* defined between the hook 22 and the base body 25, so that the hook 23 (optionally the hooks 23) of the first coupling portion 13 engages the hook 22 of the second coupling portion 14 to define the priming condition (FIGS. 8 and 9). In the priming condition, the first and the second coupling portions 13, 14 are substantially aligned along a coupling direction (FIGS. 8 and 9). In the priming condition, at least a part of the first base portion 11 is directly interposed between the second base portion 12 and the hook 22 while at least part of the base body 25 is interposed between the first coupling portion 13 and the second base portion 12.

As described above, said first and second coupling portions 13 and 14 are stably engaged to the first and second base portions 11, 12, respectively: between these portions there are no weakened portions so as to make the engagement stable and avoid undesired breakages. The structure of the coupling system 1 prevents, following the definition of the priming condition, the separation of the first and second base portions 11, 12.

The coupling system 1 further has at least one recess 29 defined on the second base portion 12 (FIGS. 2, 5-9, 13); the recess defines an open peripheral profile having a "C" shape, a "U" shape or a "V" shape. In detail, the recess 29 defines a part of the peripheral edge of the second base portion 12 at the end portion joined in a single piece to the second coupling portion 14. In greater detail again, the recess 29 represents a through opening of the second base portion 12, facing the second coupling portion 14. The recess 29 is configured to allow, in the priming condition of the coupling system 1, the visualization of at least at least part of the first coupling portion 13.

In the accompanying figures, a condition of the second base portion 12 is shown, joined in a single piece to the second coupling portion 14. In this condition, the recess 29 is defined at the joining edge between the second base portion 12 and the second coupling portion 14.

The coupling system 1 further includes at least one slit 15 (the accompanying figures show a non-limiting configuration of the coupling system 1 having two slits 15) defined on the first base portion 11. The slit 15 has a rectangular shape; alternatively, the slit 15 may have a circular, trapezoidal, triangular shape or a combination thereof. In the accompanying figures, a slit 15 has been shown placed on the first base portion 11 at a joining edge between said first base portion 11 and the first coupling portion 13. The slit 15 (each slit) is configured to allow, at least in the priming condition of the coupling system 1, the through-passing of at least one opening device 70 configured for allowing the disengagement of the first and second coupling portion 12, 13 and consequently the separation of the first and second base portions 11, 12.

The opening device 70 may be part of the coupling system 1 and be configured for passing through the slit 15 and being interposed between the first and the second coupling portion 12, 13 in such a way as to allow the disengagement thereof. In detail, the opening device 70 is interposable between the hooks 22 and 23 so as to free the respective gripping edges 22*a*, 23*a* and allow the first coupling portion 13 to exit from the opening 14*a* for the separation of the first and second coupling portions 13, 14 (consequently the separation of the first and second base portions 11, 12).

In detail, the opening device 70 includes a tab in sheet material, for example made of paper sheet material, which has a gripping portion 71 from which one or more appendages 72 emerge. The appendages 72 may have a polygonal shape, for example substantially square or rectangular or trapezoidal. The appendages 72 are configured and sized to fit inside the slit 15 in such a way as to contact, in the priming condition of the coupling system 1, the first and the second coupling portion 12, 13 and disengage them. In the accompanying figures, an opening device 70 is shown including two appendages 72 projecting from the gripping portion 71. The appendages 72 extend away from an abutment edge 73 defined in interposition therebetween. According to such an embodiment, the opening device 70 has a substantially "C" or "H" or "A" conformation. When the opening device 70 is inserted into the slits 15 (in the presence of two appendages, the first base portion 11 includes two respective slits), the abutment edge 73 abuts an abutment edge 21 of the first base portion so as to limit the advancement of the opening device 70 within the slits 15 themselves.

The first and second base portions 11, 12 are configured for switching from the priming condition, in which they are engaged to each other by means of the first and second coupling portion 13, 14, to a separation condition exclusively in the condition of the opening device 70 inserted in the slit 15, optionally interposed between said first and second coupling portion 12, 13. In fact, the opening device constitutes a key which, once inserted into the slit 15, allows the separation between the first and second coupling portion 13, 14; in the absence of the opening device 70, the coupling system 1 cannot switch from the priming condition to an open condition in which the coupling portions are separated (disengaged), a condition which makes the coupling system child-proof.

As can be seen in the accompanying figures, the coupling system 1 further includes a closing septum 50 which at least partly occludes the slit 15; in particular, the closing septum 50 is configurable between:

- a first operative condition wherein the closing septum 50 at least partly occludes the slit 15 and hinders the through-passing of the opening device 70,
- a second operative condition wherein at least part of the septum 50 is configured to take a different position with respect to the position taken by the closing septum 50 itself in the first operative condition to allow the through-passing of the opening device 70.

In fact, during the switching from the first to the second operative condition, at least a part of the septum is configured for irreversibly moving so as to allow the through-passing of the device 70. The fact that such a septum 50 undergoes an irreversible displacement (for example a rupture of the septum or a separation thereof from the first base portion 11) allows the same to give evidence to the user of a first insertion of the device 70 and therefore of a first opening of the coupling system or an attempt to tamper with the latter.

In fact, the closing septum 50, in the first operative condition, occludes at least 50%, optionally between 60% and 100%, of the passage section of the slit 15; the passage defined through the slit 15, in the second operative condition of the closing septum 50, is greater than the passage defined through the slit 15, in the first operative condition of the closing septum 50. The coupling system 1 may include a single closing septum 50 suitable for occluding one or more slits or it may include (as shown in the accompanying figures) a distinct closing septum 50 for each slit present on the first base portion 11.

In detail, the closing septum 50 may include a tab 50*a* (FIGS. 4-6, 8 and 15) arranged inside the slit 15 and engaged to the first base portion 11 by means of a weakened portion configured to allow the separation of said tab 50*a* from the first base portion 11 following the condition of first insertion of the opening device 70 through the slit 15 (or in the case of thrust of the opening device 70 through the slit 15). In fact, the tab 50*a* represents an occlusion element of the slit 11 easily detachable (separable) from the first base portion 11. Should it be desired to open the coupling system 1 by disengaging the first and second coupling portion 13 and 14, it would be necessary to insert the opening device 70 through the slit 15: during this condition, the tab 50*a* would be separated from the first base portion 11 with the consequent possibility of the coupling system 1 to give evidence of a first opening attempt thereof.

Alternatively, the closing septum 50 may include at least one membrane 50*b* located at the slit 15 (FIGS. 3, 9 and 14) and configured for breaking following the first insertion condition of the opening device 70 through the slit 15 (or in case of thrust of the opening device 70 through the slit 15). The membrane 50*b* constitutes a weakened portion adapted to break if crossing the slit 15 crossing: during this condition, a visible damage to the membrane 50*b* would be caused, with consequent possibility of the coupling system 1 to give evidence of a first opening attempt or attempted tampering thereof. The possibility of occluding the slit using a tab 50*a* in combination with a membrane 50*b* is not excluded.

In this way, the coupling system 1, besides being of the child-proof type (thanks to the priming of the coupling system 1 which requires the particular use of an opening device 70) is able to define a tamper-evident system.

As shown for example in FIGS. 13-15, the coupling system 1 may further include a tamper-evident coating 52 associated with the sheet material of at least one of the first and second coupling portion 13, 14; the coating 52 covers at least in part the sheet material of at least one of the first and second coupling portion 13, 14 facing, in the priming condition of the coupling system 1, towards the second base portion 12. The coating 52 is configured for visually signaling, following a scraping stress of the coating itself, an attempt to tamper of the coupling system 1. For example, the coating may be configured for being damaged in the event of contact with an external body with respect to the coupling system 1; in this way, the coating 52 can prove an attempt to disengage the first and second coupling portion 13, 14 without using the opening device 70.

Figure 25:
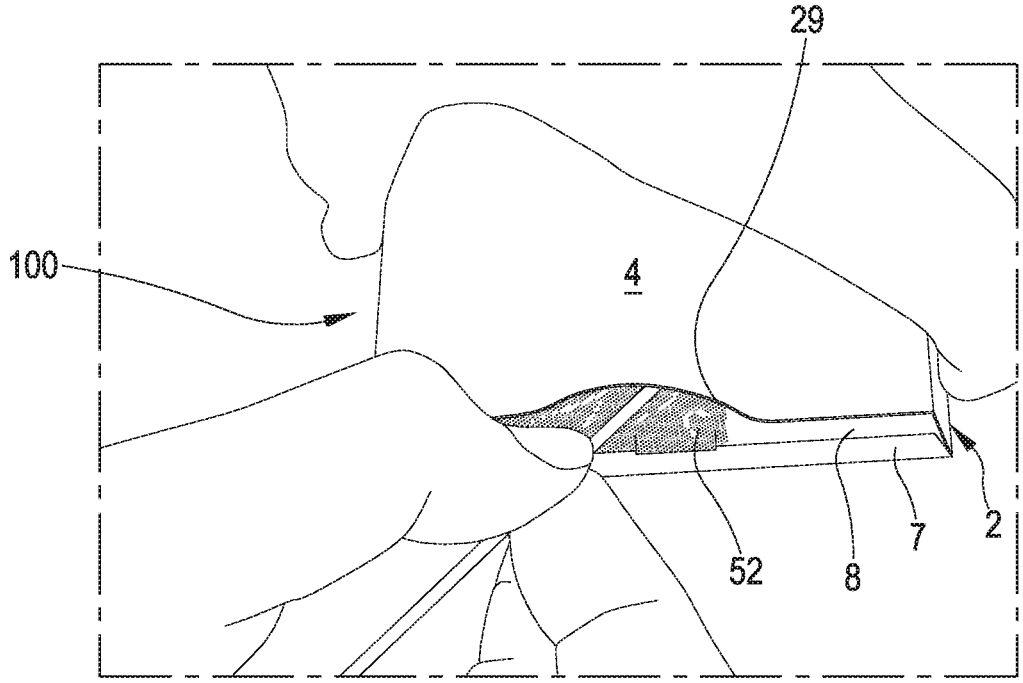
FIG. 25 schematically shows an attempt at tampering with a container according to the present invention.
Figure 26:
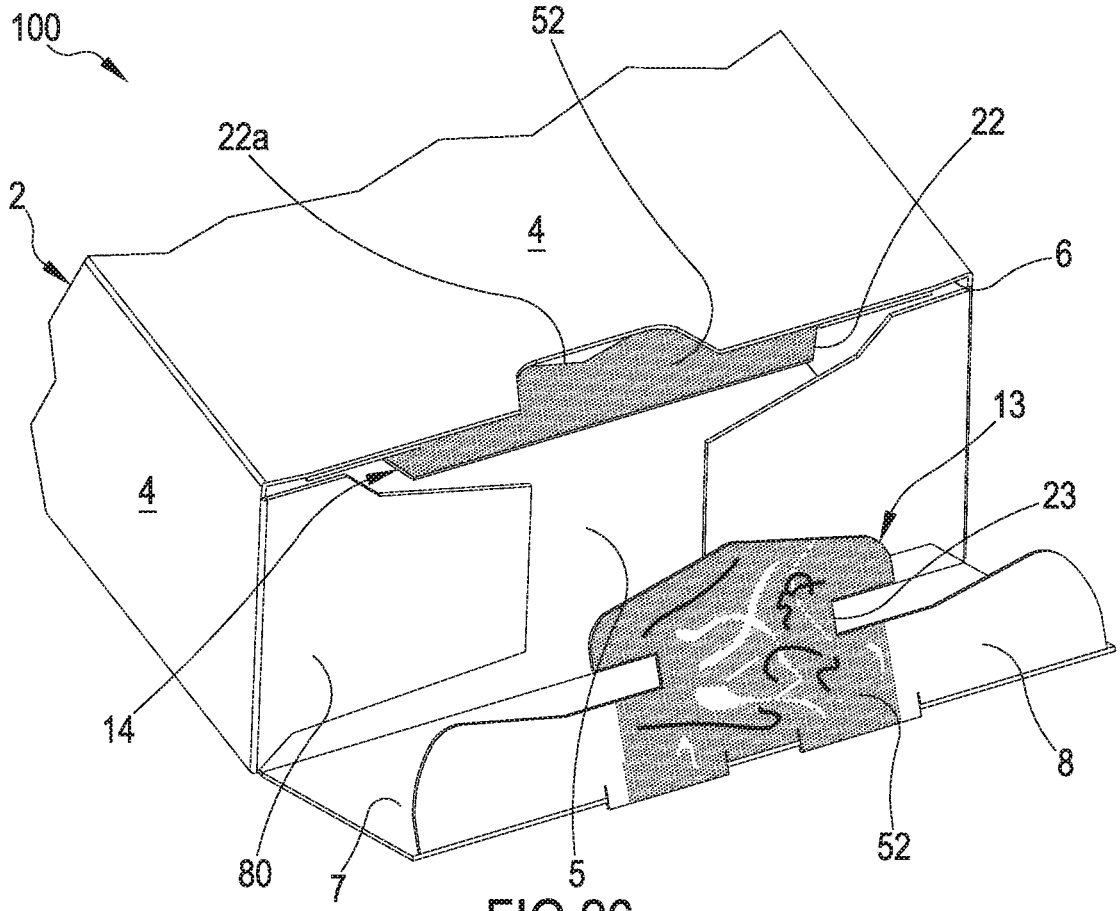
FIG. 26 schematically shows the container of FIG. 25 after a tampering attempt.

FIGS. 25 and 26 show a coupling system 1 associated with a container 100. FIG. 25 schematically shows the tampering step of the coupling system 1 which allows it to be traced by means of the coating 52 which, as shown in FIG. 26, is configured for visually signaling (for example due to damage thereof) such a tampering.

Figure 27:
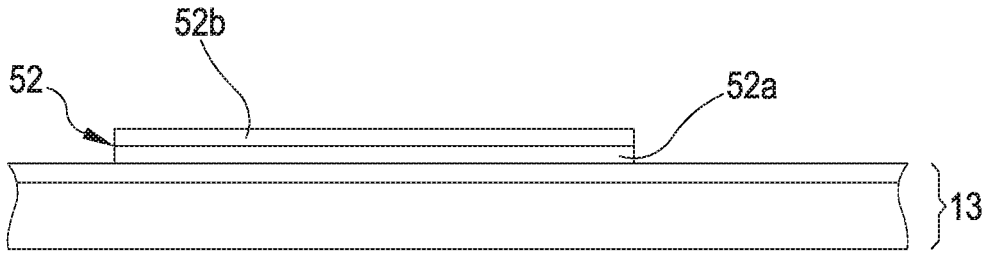
FIGS. 27-29 schematically show a sheet material including a tamper-evident coating.
Figure 28:
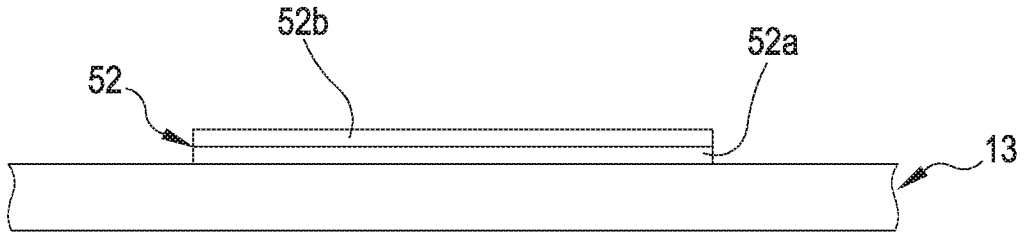

The evident coating 52 may be of the multilayer type, as shown in FIGS. 27 and 28 and may comprise:

- a support substrate 52*a* directly constrained to the sheet material of at least one between the first and the second coupling portion 13, 14,
- a removable layer 52*b* superimposed to the support substrate 52 so that said support substrate 52*a* is interposed between the removable layer 52*b* and the sheet material to which the support layer 52*a* is constrained directly.

The support layer 52*a* is configured to generate an adhesion with the sheet material of at least one between the first and the second coupling portion 13, 14 greater than the adhesion of the same substrate with the removable layer 52*b*.

The removable layer 52*b* has a different coloration with respect to the coloration of the support layer 52*a*, optionally of the color of the sheet material to which the support layer 52*a* is constrained directly, so that the coating 52, following the removal of at least part of the removable layer 52*b* of the support layer 52*a* may generate a visual signal representative of an attempt to tamper with the coupling system 1, as shown in FIG. 26. For example, the removable layer 52*b* may be gray in color while the support substrate 52*a* and the material in direct contact with said substrate may have a transparent and white color, respectively: damage to the removable layer would be shown by the white color of the sheet material of the first and/or second coupling portion 13, 14 to which the coating 52 is associated.

In one configuration, a symbol (image and/or word) is printed on the first and/or second coupling portion 13, 14, adapted to indicate tampering with the coupling system: the coating 52 may be placed in coverage of said symbol: damage to the coating 52 would lead to the uncovering of the symbol with consequent signaling of the attempted tampering with the coupling system 1.

The accompanying figures show a configuration in which the tamper-evident coating 52 is applied superficially to the sheet material both on the first and second coupling portions 13 and 14 on one side, in the priming condition of the system, towards the second base portion 12. The possibility of superficially applying the coating 52 only on the first coupling portion 13 or only on the second coupling portion 14 is not excluded.

In detail, the support substrate 52*a* may be a paint including at least one filmogenous polymer. Preferably, the filmogenous polymer is a thermoplastic polymer, optionally selected from: acrylic, alkyd, polyester, vinyl, phenolic and silicone resins. The paint may further include a mixture of filmogenous polymers, preferably including at least one silicone resin and at least one polymer selected from acrylic resins, alkyd resins, polyester resins, vinyl resins and phenolic resins.

The removable layer 52*b* may instead include an ink including at least one filmogenous polymer and a pigment. For example, the ink may include monomers and/or precursor oligomers of the filmogenous polymer, giving rise to the thermoplastic polymer by cross-linking following irradiation thereof with a UV light. The filmogenous polymer may include a thermoplastic polymer, for example an acrylic resin. The pigment may include a metallic pigment, for example it is aluminum powder.

Figure 29:
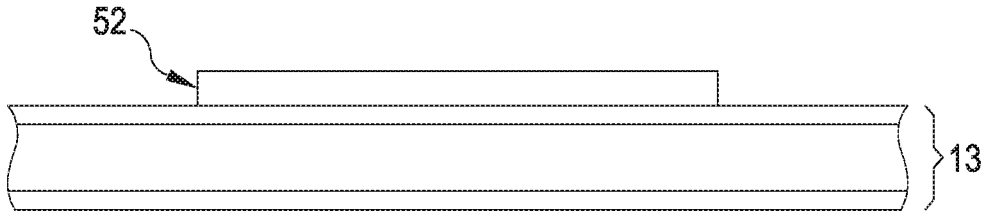

The possibility of using a single-layer tamper-evident coating 52 as shown in FIG. 29, configured to provide a visual signal if an attempt was made to force/tamper with the coupling system, is also not excluded. The single-layer coating 52 may for example include a removable layer configured to be damaged following the application of a (tangential) scraping stress, for example rubbing by means of an object made of metallic or plastic material.

As described above, the coupling system 1 is made of sheet material and in particular it may be made entirely of paper material. FIGS. 27 to 29 illustrate different configurations of the coating 52 associated, without limitation, with the first coupling portion 13.

FIG. 27 illustrates a first configuration in which the sheet material of the first coupling portion 13 includes a paper base layer 13*a* covered on the surface, on one side only, by a covering layer 13*b*, for example including a film of plastic material (for example a polythene); in this case, the sheet material of the first coupling portion 13 consists of the base layer 13*a* and the covering layer. The tamper-evident coating 52 may be associated with the covering layer 13*b* of the first coupling portion 13; in particular, the covering layer 13*b* directly engages the support layer 52*a* so that the latter is interposed between the removable layer 52*b* and said covering layer 13*b*.

FIG. 28 shows a second configuration in which the sheet material of the first coupling portion 13 includes only a paper base layer 13*a*. The tamper-evident coating 52 is associated directly with said paper base layer; in particular, the base layer 13*a* directly engages the support layer 52*a* in such a way that the latter is interposed between the removable layer 52*b* and said base layer 13*a*.

FIG. 29 illustrates a third configuration in which the sheet material of the first coupling portion 13 includes a paper base layer 13*a* covered on the surface, on both sides, by a covering layer 13*b*, for example including a film of plastic material (for example a polythene): the sheet material of the first coupling portion 13 consists of the base layer 13*a* interposed between two covering layers 13*b*. The tamper-evident coating 52 may be associated with a covering layer 13*b* of the first coupling portion 13. FIG. 29 shows a single-layer configuration of the tamper-evident coating 52.

Process for the Manufacturing of the Coupling System 1

The present disclosure also relates to a method for making a coupling system 1 according to the above description and/or according to any one of the appended claims.

The process includes the preparation of a first flat sheet 51 and the cutting thereof to define, in a single step, the first base portion 11, the first coupling portion 13 and the slit 15. If the closing septum is defined by the tab 50*a*, the latter may be defined simultaneously with the cutting step of the first sheet 51. If the septum 50 includes the membrane 50*b*, the process includes an application step, for example by gluing, of at least one membrane 50*b* at each slit made by the cutting step. The first sheet is made of sheet material, for example paper, and is cut by at least one of the following processes: punching, die-cutting, engraving, shearing, laser cutting.

The method may further include a printing step of the first flat sheet 51, preceding or following the cutting step of the same sheet 51; by such a printing step it is possible to color the first sheet 51 and/or add symbols, such as images and/or words. Printing may be performed using at least one of the following processes: digital printing, flexographic printing, letterpress printing, flexopress printing, planographic printing, or ink jet printing.

The process may further include a step of applying the tamper-evident coating on the first sheet 51; such a step may be carried out before or after the cutting step of the same sheet. If the printing step of the first sheet 51 is present, the step of applying the coating 52 is subsequent to printing. In detail, the coating application step may include the following sub-steps:

applying a support substrate 52*a* on the first sheet, applying a removable layer 52*b* on the support substrate 52*a*.

These application steps of the support substrate and the removable layer take place by means of at least one of the following processes: digital printing, flexographic printing, letterpress printing, flexopress printing, planographic printing, or ink jet printing. Optionally, said flexographic printing is a UV flexographic printing. Preferably, the application of the support substrate 52*a* and of the removable layer 52*b* includes the application of an ink on the first sheet of a paint and on the support substrate, as described above. The above paint or ink may contain the above filmogenous polymer already formed or monomers and/or precursor oligomers of the above filmogenous polymer. In this case, a UV printing process is preferably used, preferably UV flexographic printing, and the above precursor compounds are adapted to give rise to the filmogenous polymer by crosslinking following UV irradiation.

The inks or costs used for forming the support substrate and the removable layer preferably include an organic solvent or a mixture of organic solvents and, optionally, water. In the latter case, the organic solvent is a polar solvent, miscible with water.

The method further includes a step of preparing a second flat sheet 53, for example made of paper material, and the subsequent cutting of the latter to define a first portion and a second portion 53*a*, 53*b* thereon (FIGS. 1 and 12). The cutting step may include at least one of the following processes: punching, die-cutting, engraving, shearing, laser cutting. Thereafter, the second portion 53*b* is folded over the first portion so that the latter can define the second base portion 12 while the first portion 53*a* of the second sheet 53 can define the second coupling portion 14. On the first and/or second portion, an adhesive portion (for example glue) is applied so as to allow the stable bonding of these portions following the folding step: the adhesive portion allows keeping the second base portion 12 and the second coupling portion 14 folded (one above the other).

The method may further include a printing step of the second flat sheet 53, preceding or following the cutting step of the same sheet 53; by such a printing step it is possible to color the second sheet 53 and/or add symbols, such as images and/or words. Printing may be performed using at least one of the following processes: digital printing, flexographic printing, letterpress printing, flexopress printing, planographic printing, ink jet printing.

The process may further include a step of applying the tamper-evident coating 52 on the second sheet 53; such a step may be carried out before or after the cutting step of the same sheet. If the printing step of the second sheet 53 is present, the step of applying the coating 52 is subsequent to printing.

Use of the Coupling System 1

Furthermore, it is an object of the present disclosure a use of the tamper-evident coupling system 1, according to one or more of the accompanying claims and/or according to the above detailed description. The using process provides for the employment of the coupling system 1 to define at least one selected from the group of: a container, an envelope, a wrapping band of one or more products.

Container 100

The present disclosure also relates to a container 100 for containing products. The container 100 includes at least one coupling system 1 according to the above description and/or according to the appended claims.

Figure 17:
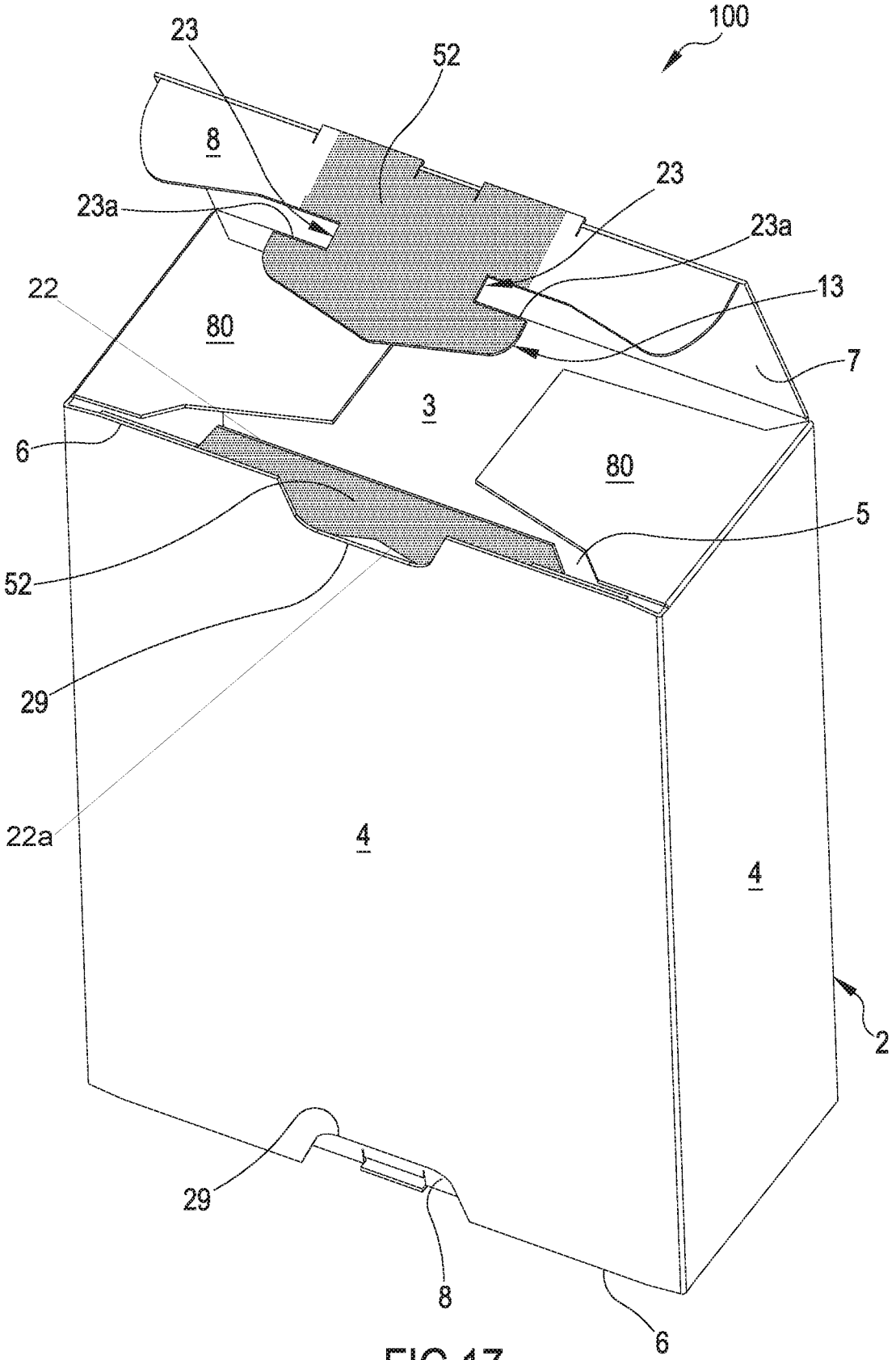
FIGS. 17 and 18 are schematic perspective views of a container according to the present disclosure.
Figure 19:
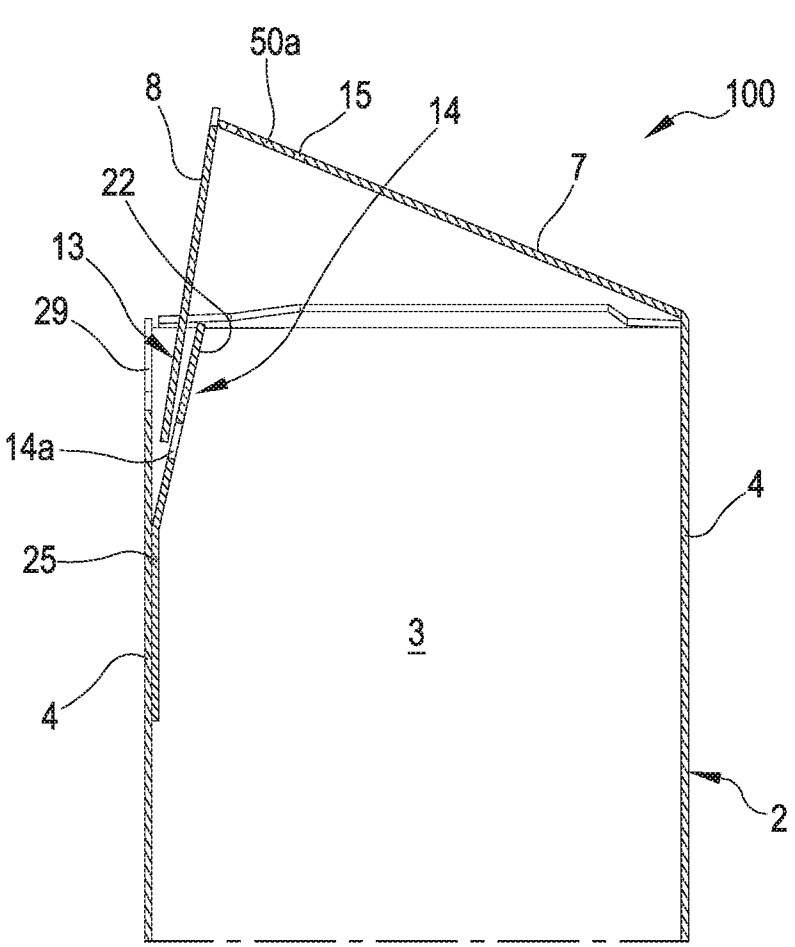
FIG. 19 is a sectional view of a coupling system according to the present disclosure.
Figure 18:
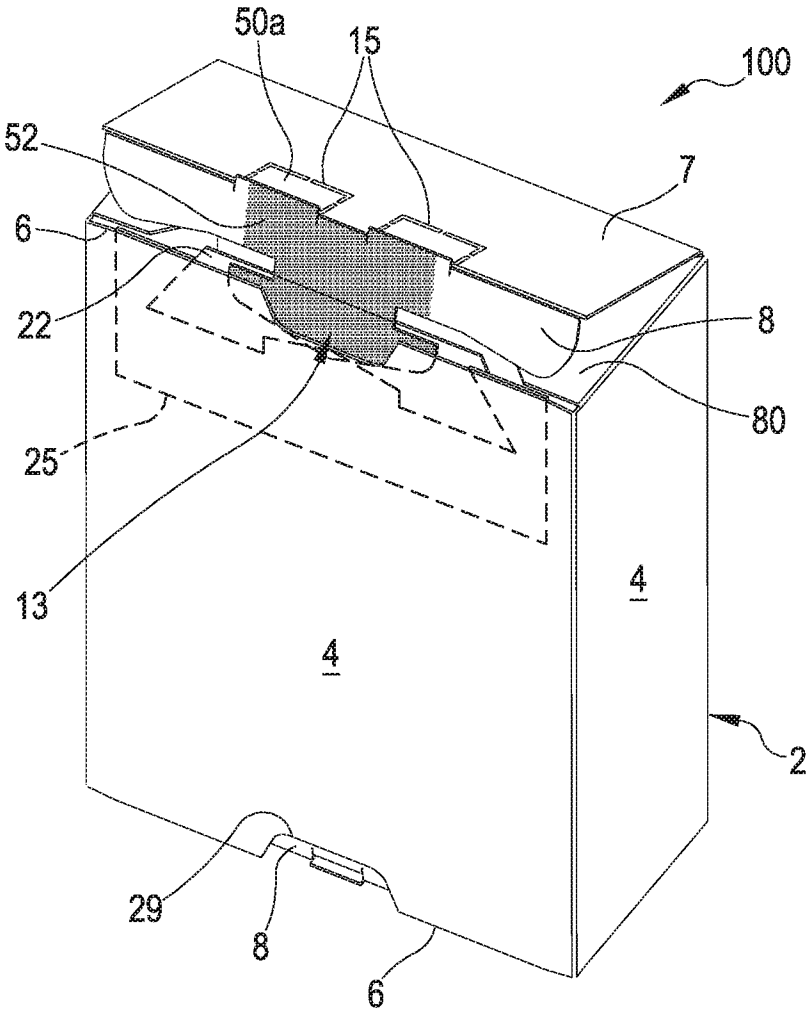
Figure 20:
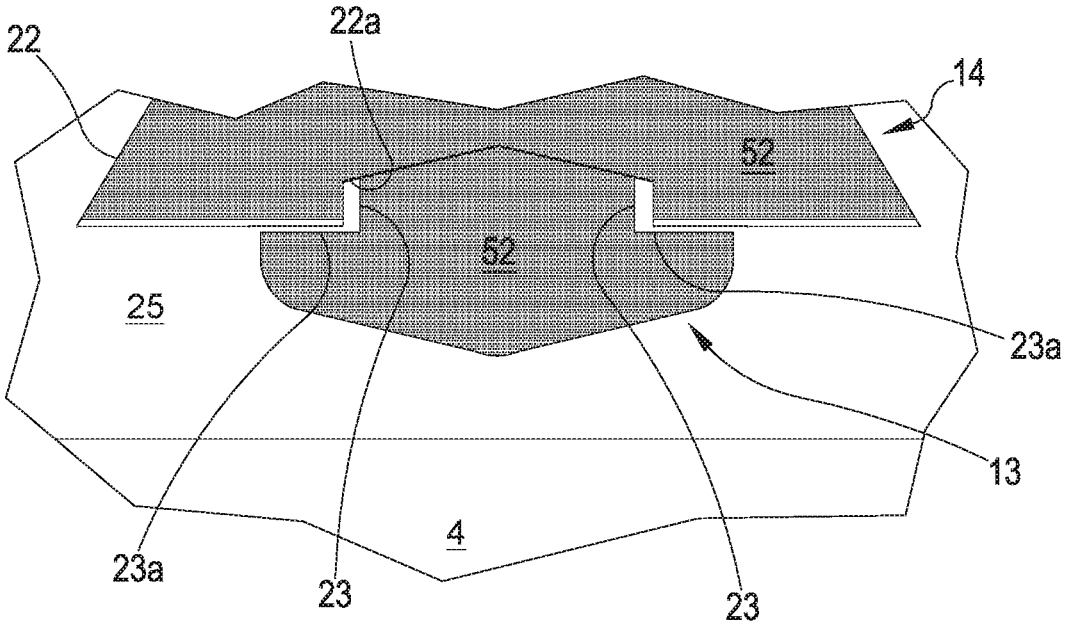
FIG. 20 is a detailed cutaway view of the coupling system in the priming condition of the container of FIG. 17.
Figure 21:
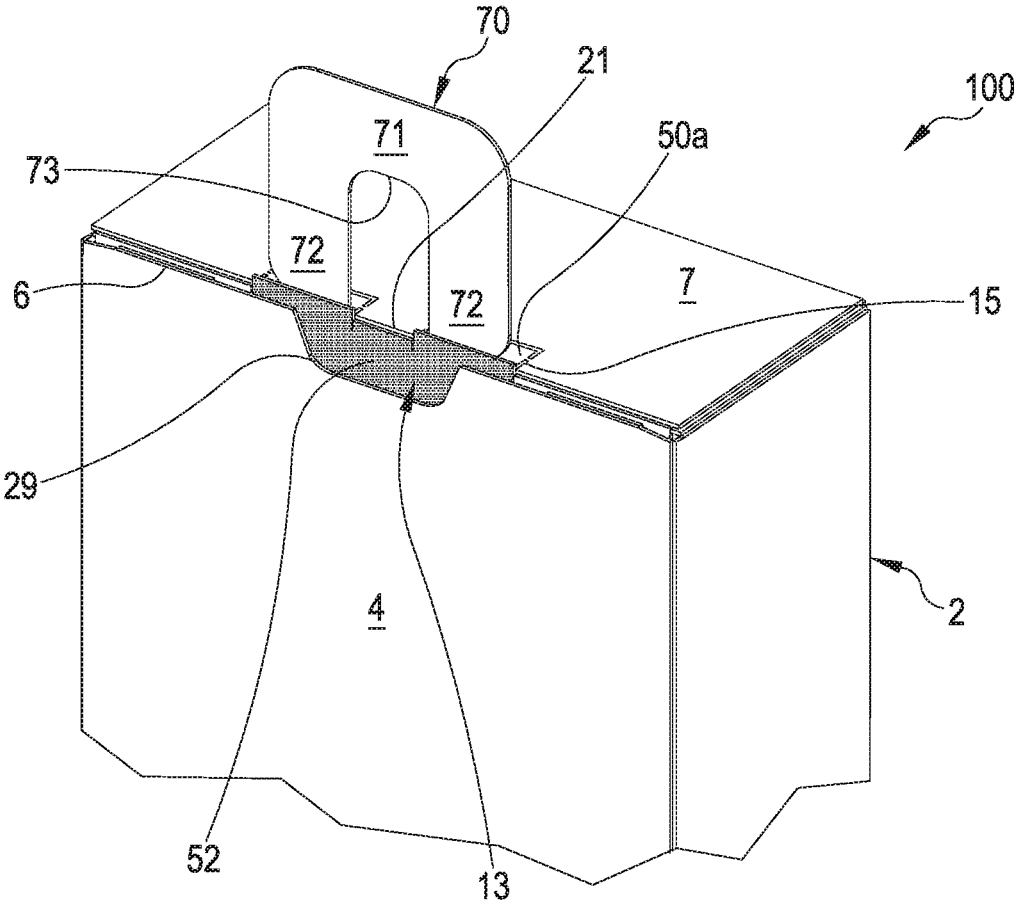
FIGS. 21-24 are schematic views illustrating the steps of opening a container according to the present invention.
Figure 22:
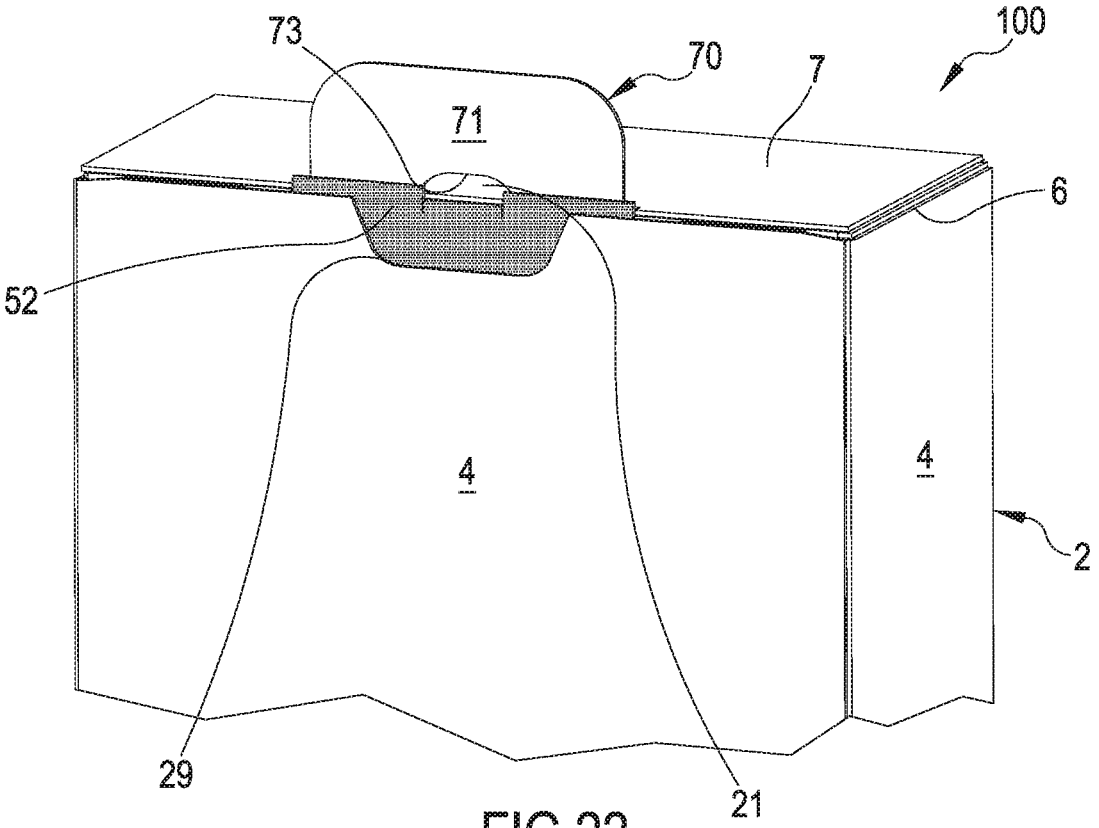
Figure 23:
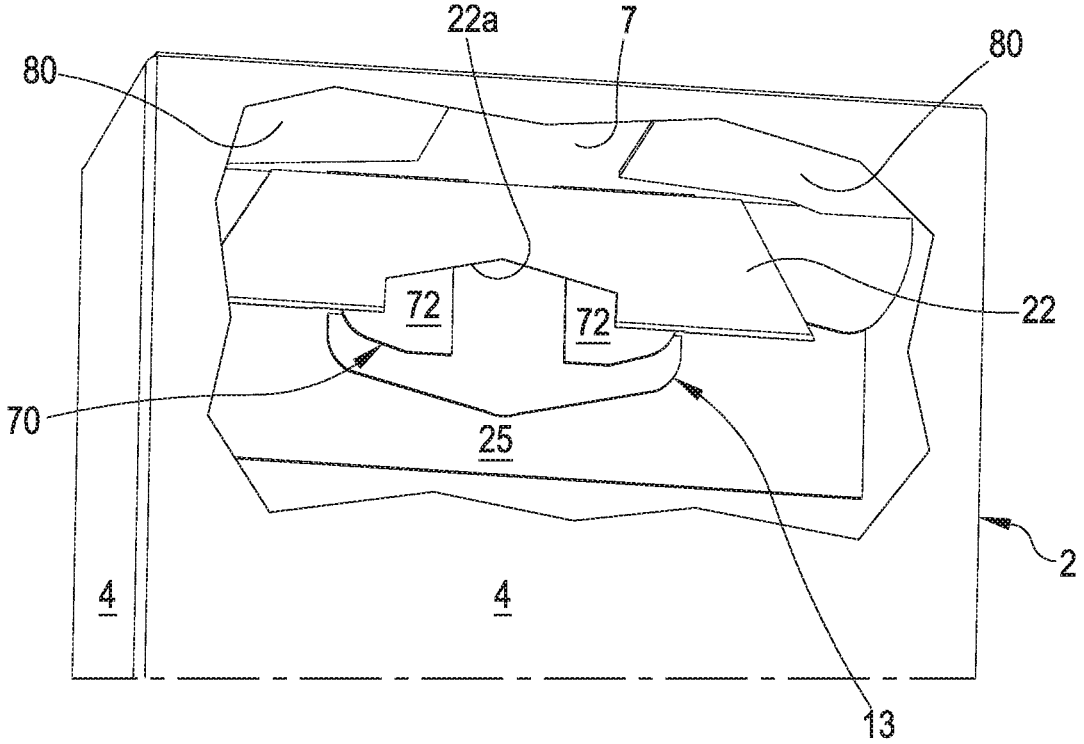
Figure 24:
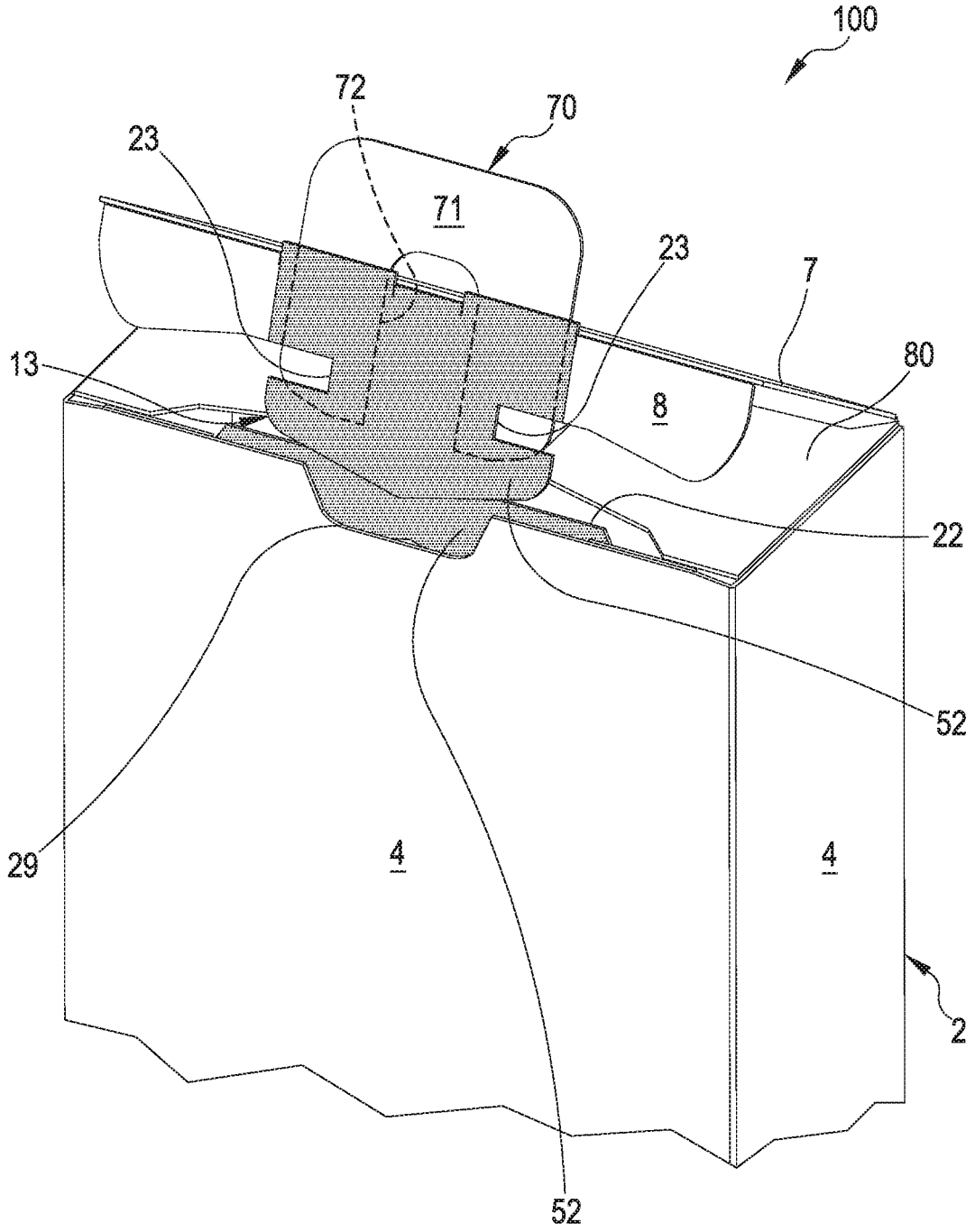

The container 100 includes a storage 2 defining an internal volume 3 and configured to house one or more products. The storage 2 includes a predetermined number of lateral walls 4 defining at least one passage opening 5 delimited by a free edge 6: the passage opening 5 is configured for putting in communication the internal volume 3 of the storage 2 with the external environment. FIG. 17 illustrates a storage 2 having two longitudinally opposite passage openings 5; in this configuration, the storage 2 defines a duct delimited laterally by the walls 4 and opened at longitudinal ends. The storage 2 has a rectangular prismatic shape (flat lateral walls 4 having a rectangular shape); the possibility of making a storage 2 having a different shape, for example square, trapezoidal or cylindrical, is not excluded. The storage 2 is made of sheet material, for example made of paper sheet material (paper or cardboard), and obtained by folding a single sheet.

The container 100 includes the coupling system 1 previously described. The first base portion 11 is rotatably constrained to the free edge 6 of the storage 2. The first base portion 11 is movable by rotation relative to the storage 2 between:

- a closing position in which at least part of the first base portion 11 prevents the communication between the internal volume 3 of the storage 2 and the external environment,
- an opening position in which the first base portion 11 allows the communication between the internal volume 3 and the external environment.

The first coupling portion 13 is borne by the first base portion 11 so that the latter is interposed between the free edge 6 of the storage 2 and the first coupling portion 13; the first coupling portion 13 extending in prolongation of the first base portion 11 on the side opposite to the storage 2. The first base portion 11 is integrally joined to the free edge 6 of the storage 2; in particular, the first base portion 11 is integrally joined to at least one lateral wall 4 of the storage 2 defining a single body of paper material.

In detail, the first base portion 11 includes a closing portion 7 of sheet material directly engaged with the free edge 6 of the storage 2 and movable by rotation with respect to the latter. The closing portion 7, during the closing position of the first base portion 11, closes the passage opening 5 of the container so as to inhibit communication between the internal volume 3 of the storage 2 and the external environment to define a closed condition of the container 100. The closing portion 7, during the opening position of the first base portion 11, allows access to the internal volume to define an open condition of the container 100. In detail, the closing portion 7 is counter-shaped to the perimeter of the passage opening 5; in the accompanying figures, an opening 5 and a closing portion having a rectangular shape have been schematized. However, the possibility of making a passage opening 5 and a relative closing portion presenting a different shape is not excluded.

The first base portion 11 further includes an insertion portion 8 configured for being inserted, in the closed position of the first base portion and thus during the closed condition of the container, inside the volume 3 of the storage 2. As can be seen in the accompanying figures, the insertion portion 8 substantially includes a flat body of sheet material. The portion 8 extends between a first and a second prevalent development surface, respectively facing outwards (directly facing a lateral wall 4 of the storage 2) and towards an internal volume 3 of the storage 2. In the closing condition of the container 100, at least a portion of the first development surface of the insertion portion 8 faces, in particular contacts, directly a part of a lateral wall 4 of the storage 2: the surface extends at least in part parallel to the wall 4 of the storage 2, in particular to a front wall of the storage 2 opposed to the wall directly connected to the closing portion 7.

The closing portion 7 and the coupling portion 8 are joined in a single piece and have a reciprocal connection edge opposite to the free edge 2 of the storage 2 with respect to the closing portion 7 itself: the coupling portion 8 is movable by rotation with respect to the closing portion 7 around to the reciprocal connection edge. The coupling portion 8, in the closed condition of the container 100, is configured to define, according to a cross section and in cooperation with the closing portion 7, a substantially "L" shape: in this condition, the coupling portion 8 extends substantially parallel to a lateral wall 4 of the storage 2. The closing portion 7 and the insertion portion 8 are present on each of the passage openings 5 of the container 100.

The first coupling portion 13 is carried by the first base portion 11 and extends in prolongation of the latter on the side opposite to the storage 2; in fact, the first coupling portion 13 is directly carried by the coupling portion 8 which is interposed between the closing portion 7 and the first coupling portion 13. In the closed position of the first base portion 11 and therefore during the closed condition of the container, the first coupling portion 13 is entirely arranged in the internal volume of the storage, substantially facing the lateral wall 4 opposite to the lateral wall 4 directly connected to the closing portion 7.

The second base portion 12 of the coupling system 1 defines at least part of the lateral wall 4 of the storage 2, while the second coupling portion 14 is at least partially disposed in the internal volume 3 of the storage 2. In detail, the second base portion 12 defines at least part of the lateral wall 4 of the storage 2 opposite to the lateral wall 4 directly connected to the first base portion 11, in particular to the closing portion 7. In detail, the second coupling portion 14 develops substantially parallel with respect to a lateral wall 4 of the container 1, optionally develops parallel to the lateral wall 4 of the storage 2 opposite to the lateral wall directly constrained to the first base portion 11. Even more in detail, the base body 25 and the hook 22 of the second coupling portion 14 are internally arranged in the internal volume 3 of the storage 2.

In the closed position of the first base portion 11 and therefore during the closed condition of the container 100, the first and second coupling portion 13, 14 are engaged with each other to define the priming condition of the coupling system 1. In the closed condition of the container (priming condition of the coupling system 1 as well as closing position of the first base portion 11), the first and second coupling portion 13, 14 are engaged with each other in the internal volume 3 of the storage 2, spaced from the free edge 6.

In order to be able to switch from the closed condition of the container to the open condition, it is necessary to insert at least part of the opening device 70 through the slit 15 to interpose the device 70 between the first and the second coupling portion 13, 14 to allow disengagement thereof.

As described above, the coupling system 1 includes the tamper-evident coating 52; the coating defines at least part of an external surface, of at least one of the first and second coupling portion 13, 14, facing the outside of the container 1 as illustrated for example in FIGS. 17, 18, 21 and 22.

As can be seen, for example, in the accompanying figures, the container 100 may further include at least one abutment portion 80 engaged on the free edge 6 of the storage 2 adjacent to the closing portion 7: the abutment portion 80, in the closed condition, is configured for being interposed between the internal volume 3 and the closing portion 7 and for cooperating with the insertion portion 8 to keep the first base portion 11 stably in the closed condition. The abutment portion 80 essentially includes a plane tab of sheet material integrally joined to the free edge 6 of the storage 2 adjacent to the closing portion 7. Also, the abutment portion 80 is configured for rotating around the free edge 6 to face, at least in the closed condition of the container 1, towards the inside of the storage 2. In greater detail, the abutment portion 80 is constrained to the edge.

Process for Manufacturing the Container 100

Another object of the present disclosure is a process for manufacturing a tamper-evident container 100, according to one or more of the accompanying claims and/or according to the above detailed description.

The manufacturing process of the container 100 includes the steps of making the coupling system 1 described above.

The process further includes a step of preparing the storage 2 including a step of preparing a third sheet 56 including at least a first and a second portion 57, 59 interconnected with a central connecting portion 58. The third sheet 56 further includes at least one first and one second lateral connecting portion 60, 61; the central connecting portion 58 is interposed between the first and the second portion 57, 59, the first portion 57 is interposed between the first lateral connecting portion 61 and the central connecting portion 58. The second portion 59 is interposed between the second lateral connection portion 60 and the central connection portion 58. Each of the portions 57, 58, 59, 60, 61 include at least two opposite longitudinal edges and two opposite end edges. The first and second portions 57, 59, the central connecting portion 58 and the lateral connecting portions 60, 61 are joined along the longitudinal edges and aligned along a single connection direction.

The step of preparing the storage 2 further includes a step of folding the third sheet 56, joining the lateral connecting portions 60, 61, to form the storage 2 exhibiting the passage opening 5 delimited by at least one free edge 6. The lateral connecting portions 60, 61 are joined to each other by means of adhesive material.

The step of preparing the storage 2 may further include a step of preparing a fourth sheet having at least one portion connected to at least one central and/or lateral connecting portion of the third sheet and emerging with respect to the latter. The portion of the fourth sheet is adapted to form a support portion 80 of the container 100.

The first sheet 51 is joined in a single piece to the second portion 59 of the third sheet 56; the first sheet is configured to be folded to form the closing portion 7 and the coupling portion 8 of the container 100, respectively.

The second sheet 53 defining the second base portion 12 of the second coupling portion 14 of the coupling system 1 is integrally joined to form a single body with the first portion 57 of the third sheet 56; in particular, the second sheet 53 emerges from the longitudinal edges of the third sheet 56.

In detail, the first, second, third and optionally the fourth sheet are joined together in a single piece to define a single blank 200 made of sheet material, optionally made of paper sheet material, foldable to form the container.

The invention claimed is:

1. A child-proof and tamper-proof container, comprising:

a storage defining an internal volume configured to house one or more products, the storage having a predetermined number of lateral walls defining a passage opening delimited by a free edge and configured to put the internal volume of the storage in communication with an external environment, a coupling system, comprising:

a first base portion comprising a first coupling portion;

a second base portion comprising a second coupling portion, the first and second coupling portions configured to define a priming configuration of the coupling system when the first and second coupling portions are engaged to each other;

wherein the first base portion of the coupling system is constrained to the free edge of the storage and moveable relative to the storage at least between:

a closing position in which at least part of the first base portion prevents communication between the internal volume of the storage and the external environment, and an opening position in which the first base portion allows communication between the internal volume and the external environment, the first coupling portion extending from the first base portion on an opposite side with respect to the storage, and the second base portion of the coupling system defining at least part of a lateral wall of the storage while the second coupling portion is at least partly arranged in the internal volume of the storage, wherein, in the closing position of the first base portion, the first and the second coupling portions of the coupling system are mutually engaged to define the priming configuration, wherein the coupling system further comprises:

a slit defined on the first base portion and configured to receive an opening device, the opening device being configured to disengage the first and second coupling portions; and a closing septum, carried by the first base portion, being adjustable to:

a first configuration in which the closing septum partly occludes the slit, thereby hindering the opening device from passing through the slit, and a second configuration in which the closing septum is configured to unblock the slit, thereby allowing the opening device to pass through the slit, wherein the closing septum comprises a tab arranged inside the slit and engaged to the first base portion, the tab being engaged to the first base portion entirely by one or more weakened portions on each side of the tab, the one or more weakened portions configured to allow the tab to irreversibly and completely detach from the first base portion following a first insertion of the opening device through the slit, or insertion of the opening device through the slit.

2. The child-proof and tamper-proof container according to claim 1, wherein the slit of the coupling system is configured for allowing insertion of the opening device in the internal volume of the storage for disengagement of the first and second coupling portions and the consequent switching of the closing system from the closed position to the open position.

3. The child-proof and tamper-proof container according to claim 1, wherein the first coupling portion is carried by the first base portion so that the first base portion is interposed, in the priming configuration of the coupling system and therefore during the closing position of the first base portion, between the free edge of the storage and the first coupling portion, the first coupling portion, in the priming condition of the coupling system and therefore during the closing position of the first base portion, being entirely arranged in the internal volume of the storage.

4. The child-proof and tamper-proof container according to claim 1, wherein the closing septum is configured to irreversibly transition from the first to the second configuration after the opening device is inserted through the slit, thereby signaling a first attempt to open the coupling system.

5. The child-proof and tamper-proof container according to claim 1, wherein an opening area of the slit in the second configuration of the closing septum is greater than the opening area of the slit in the first configuration of the closing septum.

6. The child-proof and tamper-proof container according to claim 1, wherein the first and second coupling portions comprise a first and second hook, respectively, defining an undercut portion delimited by a gripping edge, the first and second hooks configured to be stably engaged to each other during the priming configuration of the coupling system.

7. The child-proof and tamper-proof container according to claim 6, wherein the first coupling portion extends from the first base portion, wherein the second coupling portion comprises a base body comprising the second hook and a first mutual coupling portion overlapped and stably constrained to a respective second mutual coupling portion of the second base portion, the second hook extending from the base body, the second hook being overlapped and moveable relatively to the second base portion, and wherein the second hook is moveable by rotation relatively to the base body of the second coupling portion, the second hook adjustable to:

a third configuration in which the second hook extends parallel to the base body of the second coupling portion, and is arranged parallel to the second base portion, and a fourth configuration in which the second hook is arranged transversely with respect to the base body of the second coupling portion and with respect to the second base portion, thereby allowing the first coupling portion to engage with the second coupling portion.

8. The child-proof and tamper-proof container according to claim 1, wherein the first coupling portion is joined in a single piece, to the first base portion, and wherein the second coupling portion is joined in a single piece, to the second base portion.

9. The child-proof and tamper-proof container according to claim 1, wherein the opening device is insertable, at least partly through the slit to allow the disengagement between the first and the second coupling portion, thereby allowing the coupling system to transition from the priming configuration to an open configuration in which the first and the second coupling portion are disengaged and spaced apart from each other.

10. The child-proof and tamper-proof container according to claim 9, wherein the opening device passes through the slit and is interposed between the first and the second coupling portion when disengaging the first and the second coupling portion.

11. The child-proof and tamper-proof container according to claim 9, further comprising the opening device, wherein the opening device comprises a tab made of sheet material, the tab configured to damage the closing septum when inserting the tab through the slit.

12. The child-proof and tamper-proof container according to claim 9, wherein the first and second base portions are configured to switch from the priming configuration to an unconnected configuration following the insertion of the opening device through the slit and the interposition of the opening device between the first and second coupling portion.

13. The child-proof and tamper-proof container according to claim 1, comprising a tamper-evident coating associated with the sheet material of one or both of the first and the second coupling portion, the tamper-evident coating covering at least part of a surface of one or both of the first and the second coupling in the priming configuration of the coupling system near the second base portion, wherein the tamper-evident coating is configured to visually signal an attempt to tamper with the coupling system.

14. The child-proof and tamper-proof container according to claim 13, wherein the tamper-evident coating comprises a support substrate directly bound to a surface of the sheet material of one or both of the first and the second coupling portion, and a removable layer overlaid onto the support substrate such that the support substrate is interposed between the removable layer and the sheet material, wherein an adhesion strength between the support layer and the sheet material is greater than the adhesion strength between the removable layer and the support layer.

15. The child-proof and tamper-proof container according to claim 14, wherein the removable layer has a different coloration with respect to the coloration of the support layer that allows for the tamper-evident coating to change coloration after being subjected to a scraping force on at least part of the removable layer, thereby signaling an attempt to tamper with the coupling system.

16. A child-proof and tamper-proof container, comprising:

a storage defining an internal volume configured to house one or more products, the storage having a predetermined number of lateral walls defining a passage opening delimited by a free edge and configured to put the internal volume of the storage in communication with an external environment, a coupling system, comprising:

a first base portion comprising a first coupling portion;

a second base portion comprising a second coupling portion, the first and second coupling portions configured to define a priming configuration of the coupling system when the first and second coupling portions are engaged to each other;

wherein the first base portion of the coupling system is constrained to the free edge of the storage and moveable relative to the storage at least between:

a closing position in which at least part of the first base portion prevents communication between the internal volume of the storage and the external environment, and an opening position in which the first base portion allows communication between the internal volume and the external environment, the first coupling portion extending from the first base portion on an opposite side with respect to the storage, and the second base portion of the coupling system defining at least part of a lateral wall of the storage while the second coupling portion is at least partly arranged in the internal volume of the storage, wherein, in the closing position of the first base portion, the first and the second coupling portions of the coupling system are mutually engaged to define the priming configuration, wherein the coupling system further comprises:

a slit defined on the first base portion or the second base portion, the slit receiving an opening device, the opening device being configured to disengage the first and second coupling portions, a closing septum, carried by the first base portion, being adjustable to:

a first configuration in which the closing septum partly occludes the slit, thereby hindering the opening device from passing through the slit, and a second configuration in which the closing septum is configured to unblock the slit, thereby allowing the opening device to pass through the slit, wherein the closing septum comprises a membrane arranged at the slit and configured to irreversibly break following a first insertion of the opening device through the slit, wherein the membrane faces the slit and it is located, during the closing position of first base portion, inside the internal volume of the storage.

* * * * *